US010614937B2

(12) United States Patent
Miyazaki et al.

(10) Patent No.: US 10,614,937 B2
(45) Date of Patent: Apr. 7, 2020

(54) R-T-B BASED RARE EARTH PERMANENT MAGNET

(71) Applicant: TDK CORPORATION, Tokyo (JP)

(72) Inventors: Shota Miyazaki, Tokyo (JP); Keiji Takeda, Tokyo (JP)

(73) Assignee: TDK CORPORATION, Tokyo (JP)

( * ) Notice: Subject to any disclaimer, the term of this patent is extended or adjusted under 35 U.S.C. 154(b) by 230 days.

(21) Appl. No.: 15/648,759

(22) Filed: Jul. 13, 2017

(65) Prior Publication Data

US 2018/0040399 A1 Feb. 8, 2018

(30) Foreign Application Priority Data

Jul. 15, 2016 (JP) ..... 2016-140464

(51) Int. Cl.

| | |
|---|---|
| ***H01F 1/057*** | (2006.01) |
| ***B22F 3/24*** | (2006.01) |
| ***B22F 3/16*** | (2006.01) |
| ***C22C 38/00*** | (2006.01) |

(52) U.S. Cl.

CPC ..... *H01F 1/0577* (2013.01); *C22C 38/005* (2013.01)

(58) Field of Classification Search

None

See application file for complete search history.

(56) References Cited

U.S. PATENT DOCUMENTS

2013/0248754 A1* 9/2013 Sakuma ..... H01F 41/0273 252/62.55
2014/0283649 A1 9/2014 Kunieda et al.
2015/0294770 A1 10/2015 Tanaka et al.
(Continued)

FOREIGN PATENT DOCUMENTS

JP S59-046008 A 3/1984
JP 2010-034522 A 2/2010
JP 2014132628 A * 7/2014
(Continued)

OTHER PUBLICATIONS

Machine translation of JP2014-132628A. (Year: 2014).*

*Primary Examiner* — Xiaowei Su
(74) *Attorney, Agent, or Firm* — Oliff PLC

(57) ABSTRACT

An R-T-B based rare earth permanent magnet is expressed by formula: $(R1_{1-x}(Y_{1-y-z}Ce_yLa_z)_x)_aT_bB_cM_d$ in which, R1 is one or more kinds of rare earth element not including Y, Ce and La, "T" is one or more kinds of transition metal, and includes Fe or Fe and Co as an essential component, "M" is an element having Ga or Ga and one or more of Sn, Bi and Si, $0.4 \le x \le 0.7$, $0.00 \le y+z \le 0.20$, $0.16 \le a/b \le 0.28$, $0.050 \le c/b \le 0.070$, $0.005 \le d/b \le 0.028$, $0.25 \le (a-2c)/(b-14c) \le 2.00$ and $0.025 \le d/(b-14c) \le 0.500$. The magnet has a structure having a main phase, having a compound having a $R_2T_{14}B$ type tetragonal structure, and a grain boundary phase, on an arbitrary cross sectional area, an area ratio of R-T-M, T-rich and R-rich phases, with respect to a total grain boundary phase area is 10.0% or more, 60.0% or less and 70.0% or less, respectively, and the coating rate of the grain boundary phase is 70.0% or more.

4 Claims, 6 Drawing Sheets

(56) References Cited

U.S. PATENT DOCUMENTS

2015/0303744 A1 10/2015 Hashimoto et al.
2016/0086703 A1* 3/2016 Suzuki ..... C22C 38/002
252/62.55

FOREIGN PATENT DOCUMENTS

JP 2015-207662 A 11/2015
WO WO-2014148146 A1 * 9/2014 ..... B22F 9/04

* cited by examiner

R-T-B BASED RARE EARTH PERMANENT MAGNET

BACKGROUND OF THE INVENTION

1. Field of the Invention

The present invention relates to a rare earth permanent magnet, in detail, relates to the rare earth permanent magnet capable to control a microstructure of an R-T-B based sintered magnet.

2. Description of the Related Art

R-T-B based rare earth permanent magnet including a tetragonal $R_2T_{14}B$ compound as its main phase is known to show a superior magnetic characteristic, and is a representative permanent magnet with a high performance since its invention in the year 1982 (Patent Document 1). Note, "R" is a rare earth element and "T" is Fe or Fe partly substituted by Co.

R-T-B based permanent magnet, in which the rare earth element "R" is Nd, Pr, Tb, Dy or Ho, has a large anisotropic magnetic field Ha and preferable for a permanent magnet material. Among all, Nd—Fe—B based magnet, in which the rare earth element "R" is Nd, is well-balanced in saturation magnetization Is, Curie temperature Tc and anisotropic magnetic field Ha, and superior to R-T-B based rare earth permanent magnets using the other rare earth elements "R" in quantity of resources and corrosion-resistance. Thus, Nd—Fe—B based magnet is widely used.

Permanent magnet synchronous motor has been used for a power drive of consumer products, industrial machines and transportation equipment. However, permanent magnet synchronous motor in which a magnetic field of the permanent magnet is constant and an induction voltage increases in proportion to a rotational speed, and thus, driving thereof becomes difficult. Therefore, in medium and high speed ranges and under light load, a method called "a field-weakening control" came to be applied to permanent magnet synchronous motor, in order not to make induction voltage higher than the power supply voltage, making magnetic flux of the permanent magnet cancelled by a demagnetizing field due to armature current and interlinkage flux reduced. However, armature current, which does not contribute to a motor output, is continued to distribute in order to keep applying demagnetizing field. Thus, there is a problem that an efficiency of the motor is consequently reduced.

In order to solve such problems, as shown in Patent Document 2, a variable magnetic force motor using a Sm—Co based permanent magnet (a variable magnetic flux magnet) with a low coercive force which exhibits a reversible change in magnetization by applying external magnetic field has been developed. With the variable magnetic force motor, decrease in efficiency of the motor due to the conventional field-weakening control can be suppressed by reducing the magnetization of a variable magnetic flux magnet in medium and high speed ranges under light load.

With the Sm—Co based permanent magnet mentioned in Patent Document 2, however, there was a problem of being a high cost, due to expensive main materials: Sm and Co. Thus, an R-T-B based permanent magnet is applied as a permanent magnet for the variable magnetic flux magnet.

Patent Document 3 mentions the R-T-B based permanent magnet including the main phase particles having a composition of $(R1_{1-x}R2_x)_2T_{14}B$, in which R1 is at least one kind of rare earth element not including Y, La and Ce, R2 is an rare earth element including one or more kind of Y, La and Ce, "T" is one or more kind of transition metal element and including Fe or Fe and Co as essential components, satisfying $0.1 \leq x \leq 0.5$. The R-T-B based variable magnetic flux magnet further includes 2 at % to 10 at % of "M", in which "M" is at least one kind selected from Al, Cu, Zr, Hf and Ti. The R-T-B based variable magnetic flux magnet has a higher residual magnetic flux density relative to the conventional Sm—Co based permanent magnet for variable magnetic force motor. Thus, higher output and higher efficiency of the variable magnetic force motors are expected.

Patent Document 1: JP S59-46008A

Patent Document 2: JP 2010-34522A

Patent Document 3: JP 2015-207662A

DISCLOSURE OF THE INVENTION

Means for Solving the Problems

Normally, when magnetizing R-T-B based rare earth permanent magnet, a large magnetic field is applied to a degree to which magnetization of said magnet is saturated to obtain a high magnetic flux density and a high coercive force. The magnetizing field at the time is called a saturation magnetizing field.

On the other hand, with the variable magnetic force motor, the magnetization state of a variable magnetic flux magnet can be switched according to a minor loop of the magnetization curve by a magnetic field of such as an armature, when the variable magnetic flux magnet is incorporated in the motor. Thus, the motor can be driven with a high efficiency in a wide speed range regardless of a torque level. The minor loop here shows a magnetization change behavior, while sweeping a magnetic field from the field in the positive direction Hmag to the field in the reverse direction Hrev and back to Hmag.

Switching of the magnetization is performed by applying a magnetic field from the exterior, from such as a stator coil. Therefore, it is required to make magnetizing field Hmag required for the switching of the magnetization extremely smaller than the saturation magnetizing field, considering an energy saving and an upper limit of the possible external magnetic field. Considering above, at first, a variable magnetic flux magnet is required to show a low coercive force.

In order to widen a high efficiency operational range, it is necessary to increase a change amount of magnetization of the variable magnetic flux magnet from magnetization state to demagnetization state. Therefore, a squareness ratio of the above minor loop is demanded to be high at first. In addition, in case of sweeping the magnetic field from reverse magnetic field Hrev to magnetic field Hmag in the minor loop, it is demanded that the magnetization does not change till the magnetic field is as close as Hmag. Hereinafter, this desired state is expressed as "the minor curve with a higher flatness".

As mentioned above, according to the general R-T-B based rare earth permanent magnet, the magnetic characteristics such as residual magnetic flux density, coercive force, and the like are evaluated after magnetizing the magnet in a saturation magnetizing field. In case when the magnetizing field is smaller than the saturation magnetizing field, magnetic characteristics are not evaluated.

Therefore, the present inventors evaluated the magnetic characteristics of R-T-B based rare earth permanent magnet in case when the magnetizing field is smaller than the saturation magnetizing field, and found that a squareness ratio of the minor loop and a flatness of the minor curve are deteriorated when the magnetizing field becomes small. Namely, it was found that squareness ratio of the minor loop and flatness of the minor curve are influenced by the magnitude of the magnetizing field.

For instance, according to samples of Patent Article 3, when the magnetizing field is smaller than the saturation magnetizing field, the shape of hysteresis loop varies as shown in FIG. 5, even when they are measured on the same samples. FIG. 5A shows the hysteresis loop when the magnetizing field is 30 kOe, and FIG. 5B shows the hysteresis loop when the magnetizing field is 10 kOe. As obvious from FIGS. 5A and 5B, the shape of hysteresis loop greatly varies when the magnetizing field varies.

Comparing FIG. 5A and FIG. 5B, the squareness ratio and the flatness of minor curve of hysteresis loop in FIG. 5B is inferior to the same in FIG. 5A. Namely, the squareness ratio and the flatness of minor curve tend to be low when the magnetizing field becomes small. Although the squareness ratio of hysteresis loop in FIG. 5A is relatively good, the minor curve flatness in hysteresis loop in FIG. 5A is as low as in FIG. 5B.

Therefore, R-T-B based rare earth permanent magnet according to Patent Article 3 shows low coercive force, however, the minor curve flatness is low after magnetized even in the saturation magnetizing field (FIG. 5A), and becomes further lower after magnetized in a lower magnetizing field (FIG. 5B), and the squareness ratio after magnetized in said lower magnetizing field also becomes lower. As a result, with the variable magnetic force motor, using R-T-B based rare earth permanent magnet according to Patent Article 3 as the variable magnetic flux magnet, there is a problem that the high efficiency operational range cannot be widened. In other word, as the characteristic required for a magnet preferable for the variable magnetic flux magnet, only the low coercive force is insufficient, and the squareness ratio and the minor curve flatness after magnetized in a low magnetizing field are also required to be high.

In addition, the variable magnetic flux magnet installed in the variable magnetic force motor is exposed to a high temperature environment of 100° C. to 200° C. during the motor operation. Thus, it is important to keep the coercive force and a high minor curve flatness, within a suitable range for the variable magnetic force motor from a room temperature to a high temperature. Considering this point, according to Patent Article 3, only magnetic characteristics at room temperature are guaranteed, and the coercive force decreases and the minor curve flatness lowers at high temperature, and it is expected that operational range in a high efficiency narrows.

The present invention was devised considering the above situations. An object of the present invention is to provide an R-T-B based sintered magnet, showing a small lowering rate of the coercive force and the minor curve flatness at high temperature, and is preferable for a variable magnetic force motor, capable to maintain a high efficiency in a wide rotational speed range.

In general, the coercive force of R-T-B based permanent magnet at high temperature tends to lower considerably. In addition, R-T-B based rare earth permanent magnet has a nucleation-type magnetization reversal mechanism. Therefore, a movement of the magnetic domain wall is easily generated according to the applied external magnetic field, and the magnetization is greatly changed. Thus, the minor curve flatness is already lowered even at a room temperature, and tends to lower when the temperature increases. As a result of keen examination by the inventors, the invention provides R-T-B based sintered magnet, showing a small lowering rate of the coercive force and the minor curve flatness at high temperature.

In order to solve the above problems and to achieve the above object, it is an R-T-B based rare earth permanent magnet expressed by a compositional formula: $(R1_{1-x}(Y_{1-y-z}Ce_yLa_z)_x)_aT_bB_cM_d$ in which, R1 is one or more kinds of rare earth element not including Y, Ce and La, T is one or more kinds of transition metal, and includes Fe or Fe and Co as an essential component, M is an element comprising Ga or Ga and one or more kinds selected from Sn, Bi and Si, $0.4 \le x \le 0.7$, $0.00 \le y+z \le 0.20$, $0.16 \le a/b \le 0.28$, $0.050 \le c/b \le 0.070$, $0.005 \le d/b \le 0.028$, $0.25 \le (a-2c)/(b-14c) \le 2.00$ and $0.025 \le d/(b-14c) \le 0.500$, the R-T-B based rare earth permanent magnet has a structure including a main phase, including a compound having $R_2T_{14}B$ type tetragonal structure, and grain boundary phase, on an arbitrary cross sectional area, an area ratio of an R-T-M phase, having a $La_6Co_{11}Ga_3$ type crystal structure, to a total grain boundary phase area is 10.0% or more, an area ratio of T-rich phase to the total grain boundary phase area is 60.0% or less, in which said T-rich phase shows $[R]/[T]<1.0$, when [R] and [T] are number of atoms of R and T respectively, and differs from the above R-T-M phase, an area ratio of R-rich phase to the total grain boundary phase area is 70.0% or less, in which said R-rich phase shows $[R]/[T]>1.0$, when [R] and [T] are number of atoms of R and T respectively, and a coating rate of the grain boundary is 70.0% or more.

R-T-B based rare earth permanent magnet according to the invention satisfies the above compositional range, and in particular, the rare earth element R1, included in the main phase crystal grains, is substituted by such as "Y". Thus the low coercive force is achieved. This is due to a high anisotropic magnetic field of the rare earth element R1 (represented by Nd, Pr, Tb, Dy and Ho) included in the main phase crystal grains, relative to such as "Y". In the invention, "Y" may be partly substituted by Ce, La. Ce and La also show a low anisotropic magnetic field of R-T-B compound, similar to "Y" and in relative to R1, thus, they are effective for lowering coercive force.

By making the amounts of Ce and La to a total amount of Y, Ce and La within the above compositional range $0.00 \le y+z \le 0.20$, sufficient low coercive force can be obtained. In addition, it becomes possible to make lowering rate of the coercive force and the minor curve flatness at high temperature small.

Temperature dependency of anisotropic magnetic field according to R-T-B compound, the main phase crystal grains in sintered magnet, in case when elements included in the above R1 are used as "R", all show a large monotonous decrease at high temperature. Namely, coercive force shows a large monotonous decrease at high temperature. While, in case when such as "Y" is used as "R", Curie temperature of R-T-B compound is high, and that temperature dependency of anisotropic magnetic field shows slight monotonous increase till near 150° C. Thus, said coercive force slightly and monotonically increase at high temperature.

For the reason mentioned above, by increasing the ratio of such as "Y" in all the rare-earth element included in R-T-B based rare-earth permanent magnet according to the invention, it becomes possible to make the lowering rate of the coercive force and the minor curve flatness at high temperature small.

According to R-T-B based rare-earth permanent magnet of the invention, a structure in which the coating rate of the grain particle phase existing around the main phase crystal grains is 70% or more can be obtained by making an atomic compositional ratio of rare earth element "R" to the same of transition metal element "T", an atomic compositional ratio of rare earth element "R" to the same of "B", and an atomic compositional ratio of transition metal element "T" to the same of element "M" (an element including Ga or Ga and one or more of Sn, Bi and Si), within the above compositional range. Thus, it becomes possible to increase the minor curve flatness and the squareness ratio at room temperature.

According to R-T-B based rare-earth permanent magnet of the invention, by making a compositional range of (a-2c)/(b-14c) and d/(b-14c) within the above range, an area ratio of an R-T-M phase, having a $La_6Co_{11}Ga_3$ type crystal structure, to a total grain boundary phase area becomes 10.0% or more.

T-rich phase includes a component exhibiting ferromagnetism such as $RT_2$, $RT_3$, $R_2T_{17}$, and etc., and an area ratio thereof is 60.0% or less. T-rich phase shows [R]/[T]<1.0, when [R] and [T] are number of atoms of R and T respectively.

R-rich phase includes a component exhibiting paramagnetism or diamagnetism, and an area ratio thereof is 70.0% or less. R-rich phase shows [R]/[T]>1.0, when [R] and [T] are number of atoms of R and T respectively.

With the abovementioned structure, it becomes possible to make the lowering rate of the coercive force and the minor curve flatness at high temperature small.

The following compositional parameters: (a-2c)/(b-14c) and d/(b-14c) are described hereinafter. (a-2c)/(b-14c) shows a ratio of a rare-earth element amount and a transitional metal element amount in the grain boundary phase of R-T-B based rare earth permanent magnet. d/(b-14c) shows a ratio of element "M" amount and a transitional metal element amount in the grain boundary phase of R-T-B based rare earth permanent magnet.

"R" in R-T-B based rare-earth permanent magnet of the invention includes R1, Y, Ce and La within the above range. Thus, the composition of the invention: $(R1_{1-x}(Y_{1-y-z}\ Ce_y\ La_z)_x)_aT_bB_cM_d$, a total composition including the main phase and the grain boundary phase, can be replaced by the following formula: [aR+bT+cB+dM]. Estimating the composition included in the grain boundary, "B" is included in the main phase and hardly include in the grain boundary phase component. Thus, a reduction of a fundamental composition $R_2Fe_{14}B$ of R-T-B compound constituting the main phase from the total composition can be lead to a composition of the grain boundary phase component. Namely, in the formula: [total composition]−[$R_2Fe_{14}B$ composition], it becomes capable to calculate the grain boundary phase composition by adjusting the coefficient to make "B" zero, and by calculating the residual component.

$$[aR+bT+cB+dM]-[2cR+14cT+cB]=[(a-2c)R+(b-14c)T+dM]$$

In the above formula, the coefficient (a-2c) of "R" is the rare earth element amount corresponding to the grain boundary phase component, coefficient (b-14c) of "T" is the transition metal element amount corresponding to the grain boundary phase component, and coefficient "d" of "M" corresponds to an element "M" amount.

From the calculation result, (a-2c)/(b-14c) is a ratio of the rare earth element amount and the transition metal element amount, which are the grain boundary phase component. d/(b-14c) shows the ratio of an element "M" amount and transition metal element amount, which are the grain boundary phase component.

According to R-T-B based rare-earth permanent magnet of the invention, it is important to increase an area ratio of R-T-M phase (A representative compound is $R_6T_{13}M$, which is an antiferromagnetism phase) having $La_6Co_{11}Ga_3$ type structure to the total grain boundary phase area.

In addition, by controlling an area ratio of T-rich phase ([R]/[T]<1.0, when [R] and [T] are number of atoms of R and T respectively, and differs from the above R-T-M phase) exhibiting ferromagnetism such as $RT_2$, $RT_3$, $R_2T_{17}$, and etc., and an area ratio of R-rich phase ([R]/[T]>1.0, when [R] and [T] are number of atoms of R and T respectively) exhibiting paramagnetism or diamagnetism, it becomes possible to increase magnetic isolation between main phase particles, and it becomes possible to decrease a local demagnetization field.

An existing area of the T-rich phase has a characteristic, in which it is easy to coagulate when segregating in the grain boundary phase, rather than existing in a specified area such as in intergranular grain boundary (the grain boundary existing between two main phase crystal grains) or in triple point (the grain boundary surrounded by three or more main phase crystal grains), and etc.

In case when the area ratio of T-rich phase to the total grain boundary phase area exceeds 60.0%, the T-rich phase of ferromagnetism coagulates in the grain boundary phase and the existing area increases. Thus, T-rich phase becomes a nucleation for magnetization reversal, and a local demagnetization field increases.

In addition, the R-rich phase has a characteristic easy to segregate at the triple point. Thus, in case when the area ratio of R-rich phase to the total grain boundary phase area exceeds 70.0%, the R-rich phase exhibiting paramagnetism or diamagnetism also segregates at the triple point. Leaking magnetic field from adjacent main phase crystal grains sneaks running through the grain boundary, and a large local demagnetization field increases.

The R-T-M phase is likely to segregate at intergranular grain boundary and is an antiferromagnetism. Thus, by decreasing an area of T-rich phase and R-rich phase, main phase crystal grains may be coated with the R-T-M phase of antiferromagnetism, sneak of the leaking magnetic field from main phase crystal grains may not be generated, and a decrease of local demagnetization field may be realized.

Considering above, when the area ratio of R-T-M phase, having $La_6Co_{11}Ga_3$ type crystal structure, to a total grain boundary phase area is 10.0% or more, the area ratio of T-rich phase to the total grain boundary phase area is 60.0% or less, and the area ratio of R-rich phase to the total grain boundary phase area is 70.0% or less, the main phase crystal grains may be coated with the R-T-M phase of antiferromagnetism and the local demagnetization field may be decreased. Thus, a decrease rate of coercive force and the same of the minor curve flatness at a high temperature can be made small.

Therefore, by the composition and the structure, the R-T-B based rare earth permanent magnet preferable for a variable magnetic force motor, capable to maintain a high efficiency in a wide rotational speed range, showing a small lowering rate of coercive force and a small lowering rate of the minor curve flatness at high temperature can be provided.

In addition, according to said R-T-B based rare-earth permanent magnet, by setting $0.4 \le x \le 0.6$, $0.00 \le y+z \le 0.10$, $0.30 \le (a-2c)/(b-14c) \le 1.50$, and $0.040 \le d/(b-14c) \le 0.500$, and on an arbitrary cross sectional area, making the area ratio of the R-T-M phase to the total grain boundary phase area to 20.0% or more, the area ratio of T-rich phase to the total grain boundary phase area to 30.0% or less, the area ratio of R-rich phase to the total grain boundary phase area to 50.0% or less, a lowering rate of coercive force and the same of the minor curve flatness at high temperature can be made outstandingly small. Thus, the R-T-B based rare-earth permanent magnet is preferable for the variable magnetic force motor.

According to the present invention, the R-T-B based rare earth permanent magnet preferable for a variable magnetic force motor, capable to maintain a high efficiency in a wide rotational speed range, in which the lowering rate of coercive force and the same of the minor curve flatness at high temperature are small, can be provided. Note, R-T-B based rare earth permanent magnet of the invention is suitable for the variable magnetic force motor.

DESCRIPTION OF THE PREFERRED EMBODIMENTS

Figure 1:
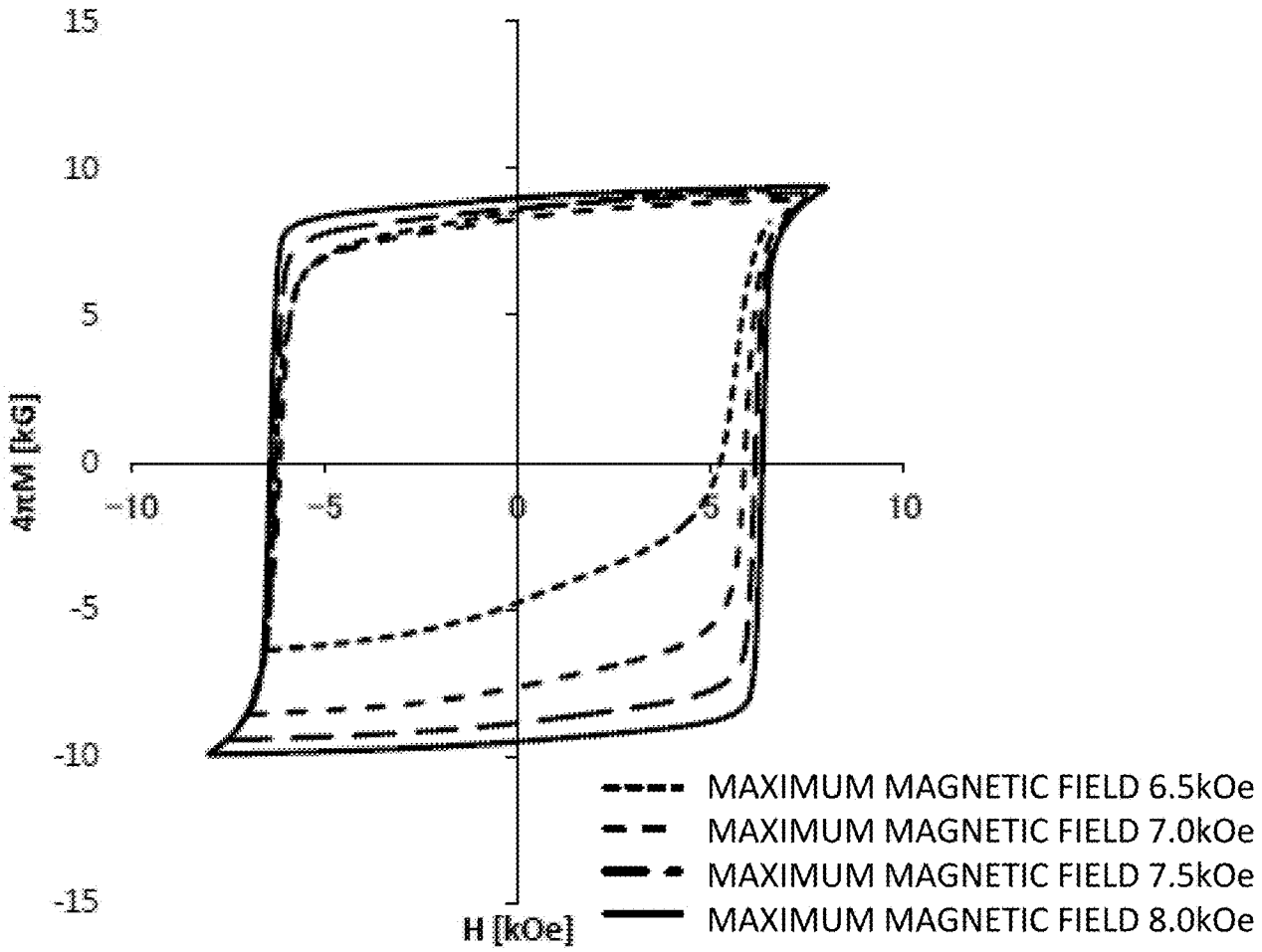
FIG. 1 is hysteresis loops measured by increasing the maximum magnetic field for measurement.

Hereinafter, the present invention will be described in detail based on the embodiments. The invention is not limited to the embodiments below. Component parts described below include, an easily estimated part by persons skilled in the art and a substantially identical part. In addition, the component parts described below can be suitably combined.

R-T-B based rare earth permanent magnet according to the present embodiment, includes a main phase, including an $R_2T_{14}B$ type tetragonal structure, and a grain boundary phase. And the composition is expressed by the following formula: $(R1_{1-x}(Y_{1-y-z}Ce_yLa_z)_x)_aT_bB_cM_d$. R1 is one or more kinds of rare earth element not including Y, Ce and La. T is one or more kinds of transition metal, and includes Fe or Fe and Co as an essential component. "M" is an element including Ga or Ga and one or more kinds selected from Sn, Bi and Si. The following ranges are satisfied in the above compositional formula, $0.4 \le x \le 0.7$, $0.00 \le y+z \le 0.20$, $0.16 \le a/b \le 0.28$, $0.050 \le c/b \le 0.070$, $0.005 \le d/b \le 0.028$, $0.25 \le (a-2c)/(b-14c) \le 2.00$, and $0.025 \le d/(b-14c) \le 0.500$.

It becomes possible to obtain a structure, in which an arbitrary cross section shows an area ratio of the R-T-M phase, having a $La_6Co_{11}Ga_3$ type crystal structure, to a total grain boundary phase area is 10.0% or more, an area ratio of T-rich phase to the total grain boundary phase area is 60.0% or less, in which said T-rich phase shows [R]/[T]<1.0, when [R] and [T] are number of atoms of R and T respectively, and differs from the above R-T-M phase, an area ratio of R-rich phase to the total grain boundary phase area is 70.0% or less, in which said R-rich phase shows [R]/[T]>1.0, when [R] and [T] are number of atoms of R and T respectively, and a coating rate of the grain boundary phase is 70.0% or more.

According to the present embodiment, in order to obtain a high anisotropic magnetic field, rare earth element R1 is preferably one kind selected from Nd, Pr, Dy, Tb and Ho. Particularly in the corrosion-resistance view, Nd is preferable. Note, the rare earth element may include impurities derived from the raw material.

According to the present embodiment, a total atomic compositional ratio "x" of Y, Ce and La, with respect to the same of a total rare earth element of said composition is $0.4 \le x \le 0.7$. In case when "x" is less than 0.4, namely, when the compositional ratio of Y, Ce and La to the composition of total sintered magnet becomes small, and the compositional ratio of Y, Ce and La to the main phase crystal grains is also small. Thus, a sufficient low coercive force cannot be obtained. While, in case when "x" is more than 0.7, the squareness ratio and the minor curve flatness after magnetized in the low magnetizing field are remarkably lowered.

This is due to the following. In the main phase ($R_2T_{14}B$ phase) composed of a compound having $R_2T_{14}B$ type tetragonal structure, $Y_2T_{14}B$ compound, $Ce_2T_{14}B$ compound and $La_2T_{14}B$ compound, which are inferior in the magnetic anisotropy in relative to such as $Nd_2T_{14}B$ compound including Nd as R1, have a significant influence.

In order to satisfy a low coercive force, and improve the squareness ratio and the minor curve flatness after magnetized in a low magnetizing field to be used in the variable magnetic force motor, "x" is preferably 0.4 or more. While "x" is preferably 0.6 or less.

According to the present embodiment, a total atomic compositional ratio (y+z) of Ce and La with respect to the total atomic compositional ratio Y, Ce and La is $0.00 \le y+z \le 0.20$.

In case when y+z is larger than 0.20, the compositional ratio of "Y" to the crystal grain composition in the main phase is small, and that the coercive force cannot be sufficiently lowered. This is due to an infection of "Ce", superior in anisotoropy relative to "Y", which becomes dominant in $R_2T_{14}B$ phase.

In case when the area ratio of T-rich phase in the grain boundary phase increases, a decrease rate of coercive force and the same of the minor curve flatness at a high temperature becomes large. This is caused by the followings. La and Ce become dominant in R-T-B based rare earth permanent magnet, and T-rich phase, not R-T-M phase having $La_6Co_{11}Ga_3$ type crystal structure, becomes easy to be formed. In order to satisfy the low coercive force, and improve the squareness ratio and the minor curve flatness after magnetized in the low magnetizing field to be used in the variable magnetic force motor, "y+z" is preferably 0.09 or less.

R-T-B based rare earth permanent magnet according to the present embodiment may include Fe or the other transition metal element in addition to Fe, as transition metal element "T" of a fundamental composition in $R_2T_{14}B$ phase, which is the main phase crystal grain. The transition metal element is preferably Co. In this case, content of Co is preferably 1.0 at % or less. Curie temperature is heightened and the corrosion-resistance is also improved by including Co in the rare earth magnet.

According to the present embodiment, the rate a/b, the atomic compositional ratio of rare earth element "R" to the atomic compositional ratio of transition metal element "T", is $0.16 \le a/b \le 0.28$.

In case when a/b is less than 0.16, generation of $R_2T_{14}B$ phase included in R-T-B based rare earth permanent magnet is insufficient. Thus, a T-rich phase having soft magnetism forms and it is not possible to make sufficient thickness of the intergranular grain boundary. Therefore, the squareness ratio and the minor curve flatness after magnetized in a low magnetizing field at room temperature are lowered. While, a lowering rate of the coercive force and the same of the minor curve flatness at a high temperature become large.

On the other hand, in case when a/b is more than 0.28, the coercive force becomes larger than the coercive force preferable for the variable magnetic force motor. In addition, R-rich phase in the grain boundary phase increases and the lowering rate of the coercive force and the same of the minor curve flatness at high temperature become large.

In order to satisfy a low coercive force, and improve the squareness ratio and the minor curve flatness after magnetized in a low magnetizing field to be used in the variable magnetic force motor, a/b is preferably 0.24 or more. While a/b is preferably 0.27 or less.

According to R-T-B based rare earth permanent magnet of the embodiment, the ratio c/b, the atomic compositional ratio of rare earth element "B" to the atomic compositional ratio of transition metal element "T", is $0.050 \leq c/b \leq 0.070$. In case when content ratio of "B" is less than 0.070, which is a stoichiometric ratio of a fundamental composition expressed by $R_2T_{14}B$, the excessive rare earth element "R" and the transition metal element "T" form the grain boundary phase, the thickness of the grain boundary phase between the adjacent main phase crystal grains is sufficiently maintained. Thus, it becomes possible to magnetically separate the main phase crystal grains. In case when c/b is less than 0.050, $R_2T_{14}B$ phase is not generated and T-rich phase or so having soft magnetism forms in a large amount. Therefore, an area of T-rich phase increases, the main phase crystal grains become easy to coagulate, therefore, the thickness of the intergranular grain boundary is not sufficiently formed.

In case when c/b is more than 0.070, the crystal grain ratio in the main phase increases and the intergranular grain boundary is not formed. Thus, in either case, the squareness ratio and the minor curve flatness after magnetized in a low magnetizing field at room temperature decrease. Further, lowering rate of coercive force and the same of the minor curve flatness at high temperature become large.

In order to satisfy a low coercive force, and improve the squareness ratio and the minor curve flatness after magnetized in a low magnetizing field, to be used in the variable magnetic force motor, c/b is preferably 0.052 or more. While, c/b is preferably 0.061 or less.

R-T-B based rare earth permanent magnet according to the present embodiment includes an element "M". Element "M" is Ga or Ga and one or more kind selected from Sn, Bi and Si. The rate d/b, the atomic compositional ratio of "M" to the atomic compositional ratio of transition metal element "T", is $0.005 \leq d/b \leq 0.028$. In case when d/b is smaller than 0.005 or when larger than 0.028, an area ratio of R-T-M phase having $La_6Co_{11}Ga_3$ type crystal structure decreases. Thus, the thickness of the intergranular grain boundary is insufficient, and that the squareness ratio and the minor curve flatness after magnetized in a low magnetizing field at room temperature decrease and a lowering rate of coercive force and the same of the minor curve flatness at high temperature become large.

In order to secure a low coercive force, and improve the squareness ratio and the minor curve flatness after magnetized in a low magnetizing field, to be used in the variable magnetic force motor, d/b is preferably 0.012 or more. While, d/b is preferably 0.026 or less.

With the addition of element "M" to R-T-B based rare earth permanent magnet, reaction on a surface layer of the main phase crystal grains can be generated, and distortion, defect, and etc. can be removed. And at the same time, by the reaction with T-element in the grain boundary phase, generation of R-T-M phase having $La_6Co_{11}Ga_3$ type crystal structure is progressed, and the intergranular grain boundary showing antiferromagnetism and having a sufficient thickness is formed.

R-T-B based rare earth permanent magnet according to the present embodiment may include one or more kinds of Al, Cu, Zr and Nb, promoting reaction during powder metallurgy process of main phase crystal grains. It is more preferable to include one or more kind of Al, Cu and Zr, and it is further preferable to include Al, Cu and Zr. Content amount of said elements are preferably 0.1 to 2 at % in total. Reaction on a surface layer of main phase crystal grains can be generated by adding the elements thereof to R-T-B based rare earth permanent magnet, and distortion, defect, and etc. can be removed.

The grain boundary phase of the invention includes both the intergranular grain boundary (the grain boundary existing between main phase crystal grains) and the triple point (the grain boundary surrounded by three or more main phase crystal grains). Thickness of the grain boundary phase is preferably 3 nm or more and 1 μm or less.

According to the present embodiment, the coating rate of the grain boundary phase, which is a ratio of the grain boundary phase coating outer periphery of the main phase crystal grains, is 70.0% or more.

In order to improve the squareness ratio and the minor curve flatness after magnetized in a low magnetizing field at room temperature, it is effective that the main phase crystal grains become single domain state after magnetized in a low magnetizing field Hmag, the single domain state is maintained to be stable during demagnetizing process, and the nucleation field of reverse magnetic domain is homogeneous. In order to realize the single domain state after magnetized in a low magnetizing field Hmag, decrease of a local demagnetization field is required. In case when coating rate of the grain boundary phase becomes less than 70.0%, a direct contact between an adjacent main phase crystal grains may generate and the edges on the surfaces of main phase crystal grains which are not coated by the grain boundary phase may form.

Thus, the local demagnetization field increases, and that it becomes difficult to maintain single domain state after magnetized in a low magnetizing field Hmag. In addition, when the number of the main phase crystal grains magnetically exchange-coupled with adjacent main phase crystal grains, which are regarded as the main phase crystal grains with large grain diameters, increases, the dispersion of the nucleation field of reverse magnetic domain becomes large. Thus, the squareness ratio and the minor curve flatness after magnetized in a low magnetizing field are lowered. In order to further improve the squareness ratio and the minor curve flatness after magnetized in a low magnetizing field, coating rate of the grain boundary phase is preferably 90.0% or more.

Note, the coating rate of the grain boundary phase is calculated as a ratio of the total length of an outline of the main phase crystal grains coated with the grain boundary phase having a predetermined thickness, with respect to a total length of an outline of the main phase crystal grains, on the cross section of R-T-B based permanent magnet.

According to the present embodiment, an area ratio of R-T-M phase, having a $La_6Co_{11}Ga_3$ type crystal structure, to the total grain boundary phase area on an arbitrary cross sectional area is 10.0% or more. In order to make lowering rate of coercive force and the same of minor curve flatness at high temperature small, to be preferably used for the variable magnetic force motor, the area ratio of R-T-M phase is preferably 36.7% or more, and more preferably, 60.7% or more.

In case when the area ratio of R-T-M phase becomes less than 10.0%, the area ratio of T-rich phase and the same of R-rich phase to the total grain boundary phase area increase. Lowering rate of coercive force and the same of minor curve flatness at high temperature become large.

According to the present embodiment, the area ratio of T-rich phase to the total grain boundary phase area on an arbitrary cross section is 60.0% or less, in which said T-rich phase shows [R]/[T]<1.0, when [R] and [T] are number of atoms of R and T respectively, and differs from the above R-T-M phase.

In case when the area ratio of T-rich phase becomes more than 60.0%, the grain boundary phase becomes ferromagnetism, the main phase grains are magnetically coupled, the local demagnetization field also increases, and the lowering rate of the coercive force and the same of minor curve flatness at high temperature become large.

T-rich phase preferably exists in the grain boundary phase not contacting the main phase crystal grains. In case when T-rich phase of ferromagnetism contacts the main phase crystal grains, T-rich phase may be magnetized by the leaking magnetic field from the magnetization between adjacent to the main phase crystal grains, and the local demagnetization field may be generated. Therefore, the lowering rate of the coercive force and the same of minor curve flatness at high temperature may become large.

In order to make the lowering rate of coercive force and the same of the minor curve flatness at high temperature small, to be preferable for the variable magnetic force motor, the area ratio of T-rich phase is preferably 25.6% or less.

According to the present embodiment, the area ratio of R-rich phase to the total grain boundary phase area on an arbitrary cross section is 70.0% or less, in which said T-rich phase shows [R]/[T]>1.0, when [R] and [T] are number of atoms of R and T respectively. In case when the area ratio of R-rich phase becomes more than 70.0%, R-rich phase exhibiting paramagnetism or diamagnetism exists in the triple point. Thus, the local demagnetization field increases and the lowering rate of coercive force and the same of minor curve flatness at high temperature may become large.

R-rich phase preferably exists in the grain boundary phase not contacting the main phase crystal grains. In case when R-rich phase exhibiting paramagnetism or diamagnetism contacts the main phase crystal grains, the leaking magnetic field from magnetization of adjacent main phase crystal grains converges, sneaks running through the grain boundary phase, generates a large local demagnetization field. Consequently, the lowering rate of coercive force and the same of the minor curve flatness at high temperature may be made large. In addition, it is known that the corrosion of R-rich phase is easy to progress. Thus, the corrosion resistant is improved by decreasing the area ratio of R-rich phase.

In order to make the lowering rate of coercive force and the same of the minor curve flatness at high temperature small, to be preferable for the variable magnetic force motor, the area ratio of R-rich phase is preferably 44.9% or less.

A preferable example according to the method for manufacturing the invention will be descried hereinafter.

A raw material alloy, which can provide R-T-B based magnet having a desired composition, is prepared, when manufacturing R-T-B based rare earth permanent magnet of the present embodiment. The raw material alloy can be manufactured in a vacuum or in an inert gas, desirably in Ar atmosphere, by a strip cast method or the other well-known dissolution methods.

The strip cast method is a method for obtaining an alloy in which a molten metal, obtained by dissolving a raw material metal in non-oxide atmosphere such as Ar gas atmosphere, is extrude to the rolling roller surface. Rapidly cooled molten metal on the roll is rapid cooling solidified to a thin-plate or a thin-film (a flake). Such rapid cooling solidified alloy has a homogeneous structure having a crystal grain diameter of 1 μm to 50 μm.

The raw material alloy can be obtained by not only the strip cast method but dissolution methods such as a high frequency induction dissolution. Note, in order to prevent segregation after the dissolution, for instance, it can be inclined to a water-cooling copper plate and solidified. An alloy obtained by the reduction diffusion method can be used as the raw material alloy.

Rare earth metal, rare earth alloy, pure iron, ferroboron, alloys thereof, and etc. can be used as a raw material of the present embodiment. Al, Cu, Zr and Nb can be used as an element, an alloy, and etc. Al, Cu, Zr and Nb may be included to a part of the raw material metal. Therefore, the purity level of the raw material metal must be selected, and a total additional element included amount must be adjusted to be a predetermined value. In case when impurity is mixed during manufacturing, the amount thereof must also be considered.

In order to obtain R-T-B based rare earth permanent magnet according to the invention, a two alloy method in which the main phase alloy (a low R alloy) mainly having $R_2T_{14}B$ crystal, which is the main phase grains, and an alloy (a high R alloy) including "R" more than said low R alloy and effectively contributes to the formation of grain boundary, are used.

According to the composition of the high R alloy, a ratio of [R'] and [T'], [R']/[T'] is preferably close to 0.46, when [R'], [T'] and [M] are number of atoms of R, T and M respectively. A ratio of [T'] and [M], [M]/[T'] is preferably close to 0.077. The stoichiometric ratio of a fundamental composition of a representative R-T-M phase having $La_6Co_{11}Ga_3$ type crystal structure is $R_6T_{13}M$. It becomes easy to form R-T-M phase having $La_6Co_{11}Ga_3$ type crystal structure in the grain boundary phase, as it gets closer to the stoichiometric ratio of R-T-M phase, and the area ratio of R-T-M phase in a total grain boundary phase can be effectively increased.

The raw material alloy is subjected to a pulverization process. In case of using the mixing method, the low R alloy and the high R alloy can be pulverized separately or collectively.

There are a coarse pulverization process and a fine pulverization process for the pulverization process. At first, the raw material alloy is coarse pulverized till the grain diameter becomes about several hundreds μm. It is desirable that stamp mill, jaw crusher, brown mill and etc. are used in inert gas atmosphere for the coarse pulverization. It is effective to pulverize by releasing hydrogen after the hydrogen storage in the raw material before said coarse pulverization process. The hydrogen releasing treatment is performed in object to decrease the hydrogen of an impurity as the rare earth sintered magnet.

For the dehydrogenation after the hydrogen storage, heat holding temperature is 200 to 400° C. or more, and desirably 300° C. The holding time varies according to the relation with the holding temperature, composition of a raw material alloy, weight, and the like, and it is set at least 30 minutes or more and desirably 1 hour or more per 1 kg. Hydrogen releasing treatment is performed in vacuum or in Ar gas flow. Note, hydrogen storage treatment and dehydrogenation treatment are not essential treatments. This waster pulverization is regarded as the coarse pulverization and a mechanical coarse pulverization may be abbreviated.

It moves to the fine pulverization process after the coarse pulverization process. Jet mill is mainly used for the fine pulverization, and coarse pulverized powder having a grain diameter of around several hundreds μm is made to an average grain diameter of 1.2 to 6 μm, desirably 1.2 to 4 μm.

Jet mill pulverizes by a method in which a high pressure inert gas is discharged from a narrow nozzle and generate a high speed gas flow, the coarse pulverized powder is accelerated with this high speed gas flow, and a collision between coarse pulverized powders or a collision with target or container wall is generated. The pulverized powder is classified by a classification rotor installed in pulverizer and a cyclone placed at lower section of the pulverizer.

A wet pulverization can be used for the fine pulverization. Ball mill, wet attritor, and etc. are used for the wet pulverization, and the coarse pulverized powder having the grain diameter of around several hundreds μm is made to have an average grain diameter of 1.5 to 6 μm, desirably 1.5 to 4 μm. In the wet pulverization, with a selection of suitable dispersion medium, the pulverization is progressed without the magnet powder to be exposed to oxygen. Thus, a low oxygen density fine powder can be obtained.

A fatty acid, derivatives thereof or a hydrocarbon can be added in order to improve lubrication and orientation when molding. For instance, the fatty acid group of stearic acid base, lauryl acid base or oleic acid base, such as zinc stearate, calcium stearate, aluminum stearate, amide stearate, amide laurate, amide oleate, ethylenebisisoamide stearate, and hydrocarbons of paraffin, naphthalene, and etc. may be added around 0.01 to 0.3 wt % during the fine pulverization.

The fine pulverized powder is submitted to the molding in magnetic field. Molding pressure when molding in the magnetic field is 0.3 ton/cm$^2$ to 3 ton/cm$^2$ (30 MPa to 300 MPa). The molding pressure may be constant from the beginning to the end of molding, gradually increased or gradually decreased, or irregularly changed. Orientation becomes good as the molding pressure is low, however, in case when the molding pressure is excessively low, strength of the molding body becomes insufficient and a handling problem is generated. Thus, the molding pressure is selected from the above range considering this point. The final relative density of a molded body obtained from molding in the magnetic field is generally 40 to 60%.

Magnetic field applied may be around 960 kA/m to 1,600 kA/m. The applied magnetic field is not limited to a static magnetic field, and it may be a pulse-like magnetic field. In addition, the static magnetic field and the pulse-like magnetic field can be simultaneously used.

The molded body is submitted to a sintering process. The sintering is processed in a vacuum or in an inert gas atmosphere. Holding temperature and holding time during the sintering are required to be regulated corresponding to conditions, such as the composition, the pulverization method, the difference between an average grain diameter and the grain size distribution. It may be approximately 1,000° C. to 1,200° C. for 1 minute to 20 hours, however, it is preferably 4 to 20 hours.

After the sintering, an aging treatment may be applied to the obtained sintered body. After going through this aging treatment, constitution of the grain boundary phase formed between adjacent $R_2T_{14}B$ main phase crystal grains is determined. The microstructure is controlled not only with this process, but it is also determined considering the balance between conditions of the above sintering process and state of the raw material fine powder. Therefore, considering heat treatment conditions and the microstructure of the sintered body, heat treatment temperature, time and cooling rate may be defined. Heat treatment may be progressed within a range of 400° C. to 900° C.

The R-T-B based rare earth permanent magnet according to the present embodiment can be obtained by the method described above; however, said method for manufacturing is not limited thereto and can be suitably varied.

Definition and evaluation method of the magnetizing field Hmag and an indicator of the squareness ratio and the minor curve flatness according to R-T-B based rare earth permanent magnet of the present embodiment.

Measurement required for the evaluation is performed by BH tracer. In the present embodiment, the minimum necessary magnetic field in which the squareness ratio and the minor curve flatness have reproducibility to the repetitive measurement among a magnetizing field Hmag is defined as a minimum magnetizing field Hmag.

Concrete evaluation is shown in FIG. 1. Hysteresis loop is measured increasing the maximum magnetic field for measuring with constant interval of the magnetic field. In case when the hysteresis loop closes and shows a symmetric shape (difference of the coercive force between positive side and negative side is less than 5%), reproducibility is guaranteed to repetitive measurement. Thus, the obtained minimum necessary maximum magnetic field is defined as the minimum magnetizing field Hmag.

Next, the squareness ratio $Hk_{_Hmag}/HcJ_{_Hmag}$ of the minor loop measured in the minimum magnetizing field Hmag is used as the squareness ratio in the minimum magnetizing field. Here, $Hk_{_Hmag}$ is a value of magnetic field which is 90% of residual magnetic flux density $Br_{_Hmag}$ in the second quadrant of minor loop measured with minimum magnetizing field Hmag. And $HcJ_{_Hmag}$ is coercive force of the minor loop measured in the minimum magnetizing field Hmag.

Figure 2:
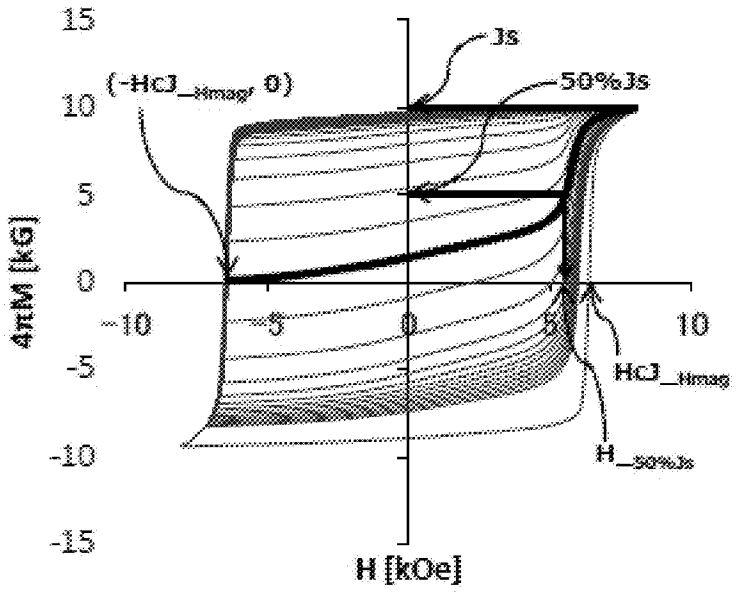
FIG. 2 is a model diagram showing minor loops.

Indicator of the minor curve flatness is defined and evaluated as following. FIG. 2 shows minor loops measured by varying reverse magnetic field Hrev. The indicator of the minor curve flatness is the ratio $H_{_50\%Js}/HcJ_{_Hmag}$, which is a ratio of $H_{_50\%Js}$, a magnetic field where the magnetic polarization becomes 50% of the magnetic polarization Js when the minimum magnetizing field Hmag is applied, to $HcJ_{_Hmag}$, the coercive force of the minor loop after magnetized in the minimum magnetizing field Hmag, according to the magnetization curve (a thick line in FIG. 2) from the operational point ($-HcJ_{_Hmag}$, 0), which is the coercive force at the second and third quadrants of the minor loops, among the magnetization curves from a plural reverse magnetic field Hrev.

To be used as the variable magnetic flux magnet, the minimum magnetizing field Hmag of rare earth magnet according to the present embodiment is preferably 8.0 kOe or less, and more preferably 7.0 kOe or less.

$HcJ_{_Hmag}$ of rare earth magnet after magnetized in the minimum magnetizing field according to the present embodiment is preferably 7.0 kOe or less, and more preferably 5.3 kOe or less.

$Hk_{_Hmag}/HcJ_{_Hmag}$ of rare earth magnet after magnetized in the minimum magnetizing field according to the present embodiment is preferably at least 0.80 or more, and more preferably 0.82 or more.

$H_{50\%Js}/HcJ_{Hmag}$ of rare earth magnet after magnetized in the minimum magnetizing field according to the present embodiment is preferably at least 0.25 or more, and more preferably 0.35 or more.

Next, described is an evaluation of the lowering rate of coercive force at a high temperature according to R-T-B based rare earth permanent magnet of the embodiment. The coercive force at the minimum magnetizing field at room temperature of 23° C. is measured and defined as $HcJ_{23° C.}$. The sample is then heated at 180° C. for 5 minutes. The coercive force at the minimum magnetizing field in a state, in which the temperature of the samples are stable, is measured and defined as $HcJ_{180° C.}$. Here, The lowering rate δ (%/° C.) of the coercive force at high temperature is defined as following: $\delta=|(HcJ_{180° C.}-HcJ_{23° C.})/HcJ_{23° C.}/(180-23)\times 100|$ The lowering rate of the coercive force at high temperature is at least 0.45%/° C. or less, and preferably 0.40%/° C. or less to be used as the variable magnetic flux magnet.

An evaluation of the lowering rate of the minor curve flatness at high temperature according to R-T-B based rare earth permanent magnet of the invention will be described. At first, $H_{50\%Js}/HcJ_{Hmag}$ at the minimum magnetizing field at room temperature of 23° C. is measured and defined as $P_{23° C.}$. Then, the sample is then heated at 180° C. and held for 5 minutes. The $H_{50\%Js}/HcJ_{Hmag}$ at the minimum magnetizing field in a state, in which the temperature of the samples are stable, is measured and defined as $P_{180° C.}$. Here, the lowering rate ε(%/° C.) of the minor curve flatness at high temperature is defined as following:

$$\varepsilon=|(P_{180° C.}-P_{23° C.})P_{23° C.}/(180-23)\times 100|$$

The lowering rate of the minor curve flatness is at least 0.30%/° C. or less, and preferably 0.20%/° C. or less to be used as the variable magnetic flux magnet.

The composition and the area ratio of the various grain boundary phase according to the embodiment can be evaluated by using SEM (scanning electron microscope) and EPMA (electron probe micro analyzer). The polished cross section of samples, in which the above magnetic characteristics are evaluated, is observed. Magnification is determined to be capable to recognize approximately 200 main phase crystal grains on the polished cross section of the observation target, however, it is suitably determined according to a size, a dispersion state, and etc. of each grain boundary phase. The polished cross section may be parallel, orthogonal, or at an arbitrary angle to the orientation axis. This cross sectional area is submitted to an area analysis using EPMA, and dispersion state of each element becomes obvious and dispersion state of main phase and each grain boundary phase become obvious.

Figure 3:
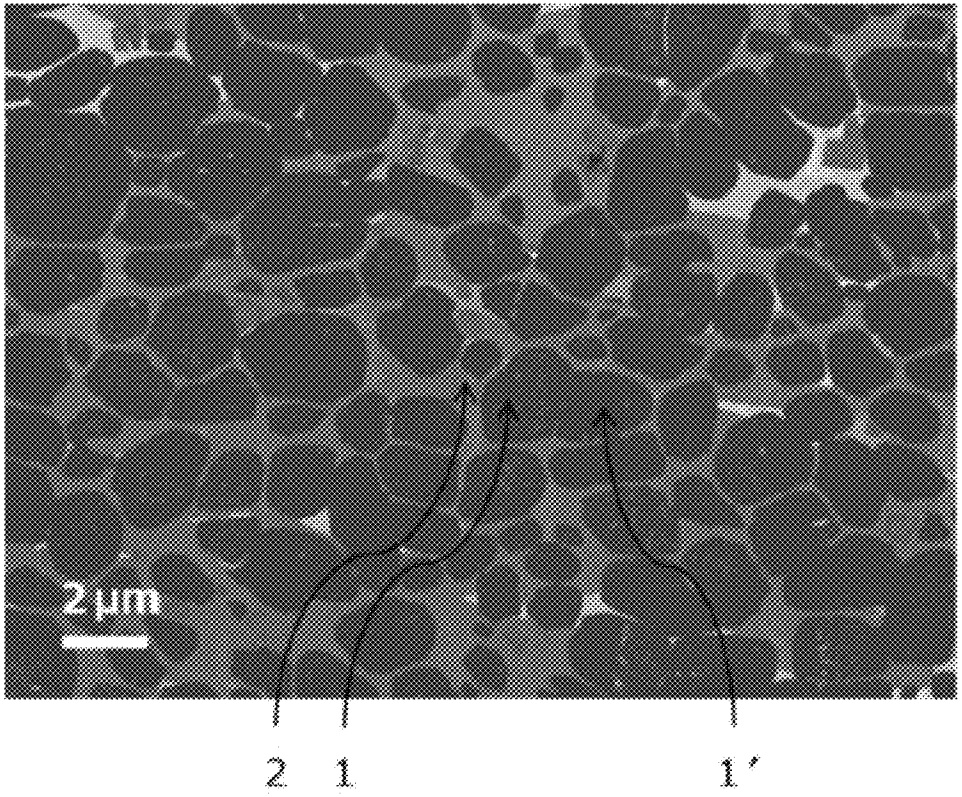
FIG. 3 is SEM backscattered electron image of a cross section according to the samples.

In addition, each grain boundary phase included in a view where the area analysis was submitted is point analyzed by EPMA, the composition is quantitatively demanded. The area belonging to R-T-M phase, the area belonging to T-rich phase, and the area belonging to R-rich phase are specified. In each area, when number of atoms of R, T and M is defined [R], [T] and [M], the area showing [R]/[T]>1.0 is distinguished as R-rich phase, the area showing 0.4≤[R]/[T]≤0.5 and 0.0<[M]/[T]≤0.1 is distinguished as R-T-M phase, and the area showing [R]/[T]<1.0 and differs from the R-T-M phase is distinguished as T-rich phase. Based on results of the area analysis and the point analysis by said EPMA, from a backscattered electron image (A contrast derived from the composition can be obtained, See FIG. 3) by SEM observed in the same field of view, said observed field of view image is read by in the image analysis software. Then, the area ratio of the areas belonging to R-T-M phase, T-rich phase and R-rich phase are calculated. Namely, said area ratio defines a ratio of areas according to each grain boundary phase to a total grain boundary phase area.

Figure 4:
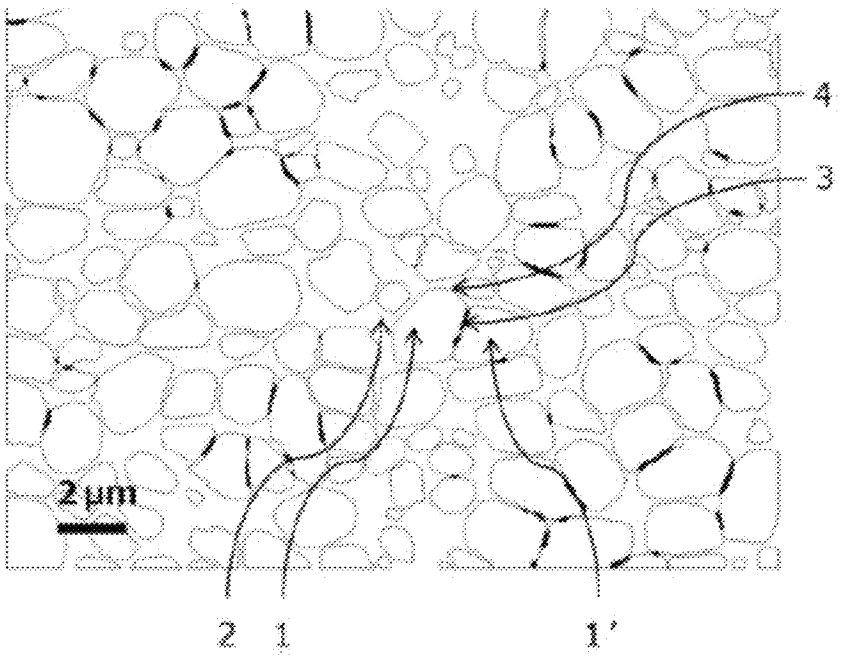
FIG. 4 is outlines of main phase crystal grains extracted by image analysis of the image in FIG. 3.
Figure 5A:
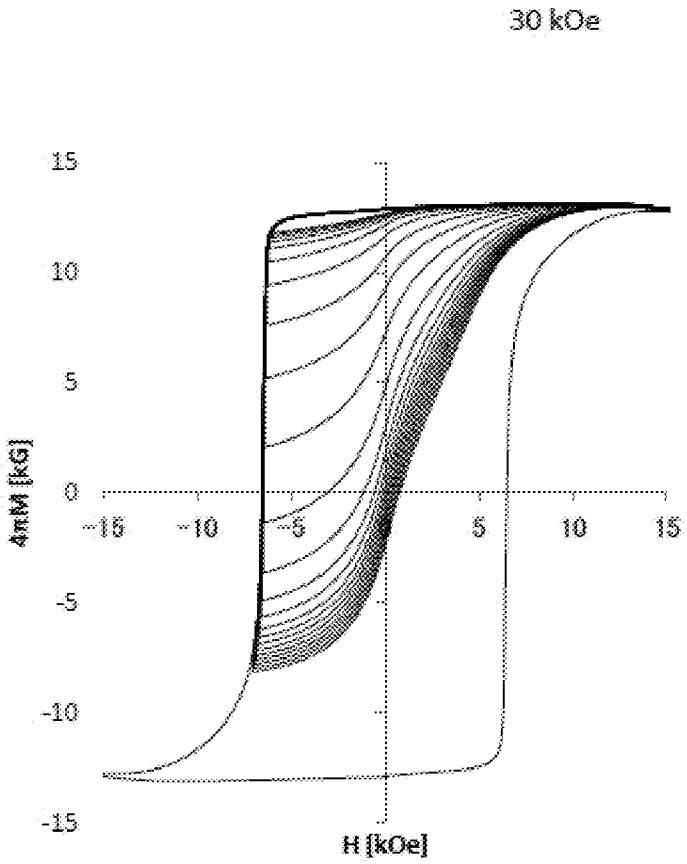
FIG. 5A is hysteresis loops according to the samples of Patent Article 3, when the magnetizing field is 30 kOe.
Figure 5B:
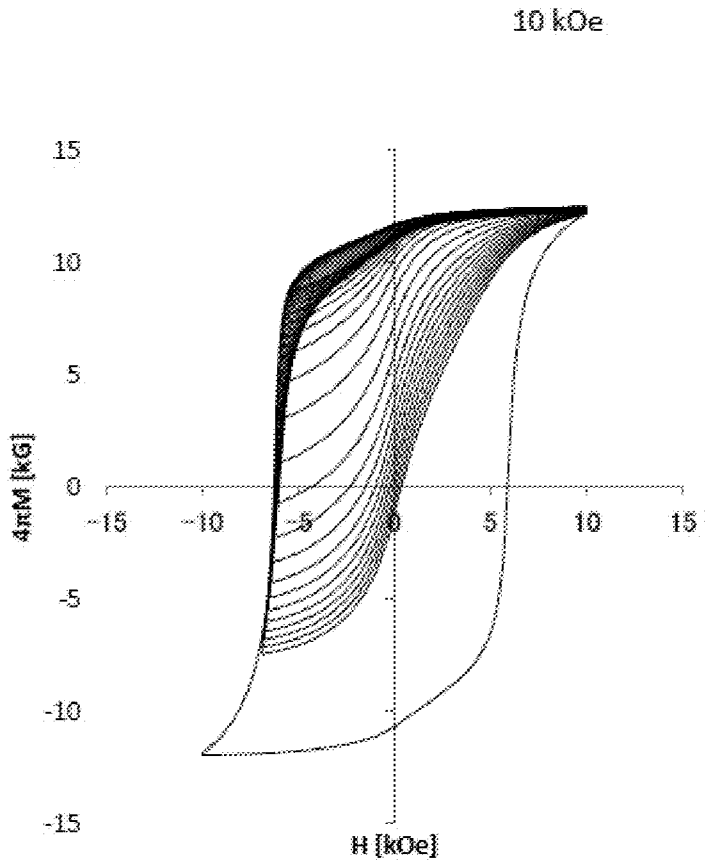
FIG. 5B is hysteresis loops according to the sample of Patent Article 3, when the magnetizing field is 10 kOe.

The coating rate in the main phase according to R-T-B based rare earth permanent magnet of the embodiment can be evaluated using the above SEM (scanning electron microscope). The backscattered electron image of SEM is read by in the image analysis software. Outlines of crystal particles in each main phase are extracted, and the cross sectional area of the main phase crystal particles is obtained. Area equivalent circle diameters, in which cumulative distribution of the obtained cross sectional area is 50% is defined D50. FIG. 4 shows an outline of the main phase crystal grains extracted from the image analysis of the image in FIG. 3. In FIG. 4, among the outlines of each crystal grain in the main phase 1 extracted from SEM backscattered electron image, a length of part 3 contacting the other adjacent crystal grain in the main phase 1' and a length of part 4 contacting the grain boundary phase 2 are distinctly calculated according to each individual particle. Hereinafter, a ratio of a total length contacting the grain boundary phase with respect to a total length of outlines of all main phase crystal grains 1 is calculated as the grain boundary phase coating rate.

Here, in the grain boundary phase, a domain, having a contrast of a composition which differs from the main phase and having a sufficient width (20 nm in case when D50 is 1.0 μm or more, and 5 nm in case when D50 is less than 1.0 μm), more than 3 nm sufficient to cut the exchange-couple, is recognized. And the outline part of the main phase crystal grains contacting said domain is detected as a contacting part with the grain boundary phase. A series of such measurement and calculation are performed on at least three fields in a cross section of the sample, and the mean value thereof is determined as a representative value of each parameter.

EXAMPLE

Hereinafter, the invention will be described in detail referring to examples and comparative examples; however, the invention is not limited thereto.

Examples 1 to 6

Each raw material of the low R alloy, according to the composition of Table 1, and the high R alloy, which can provide the composition according to R-T-B based sintered magnet of Table 2 when combined with the low R alloy, were combined, and were dissolved and casted by the strip cast method. Then a flake formed raw material alloy of the low R and the high R were obtained.

TABLE 1

| Composition of low R alloy (at %) | | | | | | | | | | |
|---|---|---|---|---|---|---|---|---|---|---|
| Nd | Y | Ce | La | Fe | Co | B | Ga | Al | Cu | Zr |
| 5.88 | 5.88 | 0.00 | 0.00 | 82.35 | 0.00 | 5.88 | 0.00 | 0.00 | 0.00 | 0.00 |

Next, the mechanical coarse pulverization was performed to these raw material alloys by stamp mill.

Next, 0.1 mass % of amide laurate as a pulverization aid was added to the coarse pulverization treated coarse pulverized powder of low R alloy and high R alloy, and fine pulverized using jet mill. During the fine pulverization, the classification condition of jet mill was adjusted to make the average grain diameter of fine pulverized power to 3.5 μm.

The obtained fine pulverized powder was filled in a mold placed in an electro magnet, and a molding in the magnetic field was performed by applying a pressure of 120 MPa in the magnetic field of 1,200 kA/m.

Subsequently, the obtained molded body was sintered. Sintering was performed in vacuum at 1,030° C. and held for four hours, and then rapidly cooled to obtain the sintered body, the R-T-B based sintered magnet. The obtained sintered body was submitted to the aging treatment in Ar atmosphere at 590° C. for one hour, and each R-T-B based sintered magnet of Exs. 1 to 6 was obtained. Note, in the present example, the above mentioned each step from the coarse pulverization treatment to sintering was performed in an inert gas atmosphere having an oxygen concentration of less than 50 ppm.

Compositional analysis of R-T-B based sintered magnet according to Exs. 1 to 6 was performed and the results are shown in Table 2. Content amount of each element shown in Table 2 was measured by Inductively Coupled Plasma Atomic Emission Spectrometry (ICP atomic emission spectrometry).

TABLE 2

| | | composition of magnet (at %) | | | | | | | | | | |
|---|---|---|---|---|---|---|---|---|---|---|---|---|
| | Process | Nd | Y | Ce | La | Fe | Co | B | Ga | Al | Cu | Zr |
| Ex. 1 | Two Alloy Method | 12.57 | 5.13 | 0.00 | 0.00 | 75.08 | 0.56 | 4.61 | 1.37 | 0.52 | 0.06 | 0.10 |
| Ex. 2 | Two Alloy Method | 10.56 | 7.34 | 0.00 | 0.00 | 74.93 | 0.57 | 4.51 | 1.40 | 0.55 | 0.05 | 0.09 |
| Ex. 3 | Two Alloy Method | 9.59 | 8.50 | 0.00 | 0.00 | 74.71 | 0.57 | 4.52 | 1.41 | 0.54 | 0.07 | 0.10 |
| Ex. 4 | Two Alloy Method | 7.43 | 10.69 | 0.00 | 0.00 | 74.66 | 0.56 | 4.56 | 1.38 | 0.58 | 0.08 | 0.07 |
| Ex. 5 | Two Alloy Method | 5.58 | 12.43 | 0.00 | 0.00 | 74.77 | 0.58 | 4.59 | 1.32 | 0.57 | 0.05 | 0.11 |
| Ex. 6 | Two Alloy Method | 3.97 | 14.09 | 0.00 | 0.00 | 74.68 | 0.59 | 4.55 | 1.42 | 0.55 | 0.06 | 0.09 |
| Ex. 7 | Two Alloy Method | 9.10 | 8.52 | 0.38 | 0.45 | 74.49 | 0.57 | 4.34 | 1.44 | 0.54 | 0.07 | 0.10 |
| Ex. 8 | Two Alloy Method | 8.76 | 7.44 | 0.86 | 0.76 | 74.98 | 0.57 | 4.48 | 1.47 | 0.53 | 0.06 | 0.09 |
| Ex. 9 | Two Alloy Method | 8.78 | 6.33 | 1.15 | 1.13 | 75.40 | 0.57 | 4.52 | 1.41 | 0.54 | 0.07 | 0.10 |
| Ex. 10 | Two Alloy Method | 9.13 | 9.13 | 0.00 | 0.00 | 75.39 | 0.58 | 3.65 | 1.42 | 0.54 | 0.07 | 0.10 |
| Ex. 11 | Two Alloy Method | 10.03 | 10.03 | 0.00 | 0.00 | 73.73 | 0.56 | 3.57 | 1.39 | 0.53 | 0.07 | 0.10 |
| Ex. 12 | Two Alloy Method | 6.80 | 6.80 | 0.00 | 0.00 | 79.39 | 0.61 | 4.16 | 1.50 | 0.57 | 0.07 | 0.11 |
| Ex. 13 | Two Alloy Method | 7.14 | 7.14 | 0.00 | 0.00 | 78.76 | 0.60 | 4.13 | 1.48 | 0.56 | 0.07 | 0.11 |
| Ex. 14 | Two Alloy Method | 9.09 | 9.09 | 0.00 | 0.00 | 75.18 | 0.57 | 3.94 | 1.42 | 0.54 | 0.07 | 0.10 |
| Ex. 15 | Two Alloy Method | 10.00 | 10.00 | 0.00 | 0.00 | 73.51 | 0.56 | 3.85 | 1.39 | 0.53 | 0.07 | 0.10 |
| Ex. 16 | Two Alloy Method | 10.58 | 10.58 | 0.00 | 0.00 | 72.44 | 0.55 | 3.80 | 1.36 | 0.52 | 0.07 | 0.10 |
| Ex. 17 | Two Alloy Method | 6.06 | 6.06 | 0.00 | 0.00 | 80.16 | 0.61 | 4.85 | 1.51 | 0.57 | 0.07 | 0.11 |
| Ex. 18 | Two Alloy Method | 6.58 | 6.58 | 0.00 | 0.00 | 79.20 | 0.60 | 4.79 | 1.49 | 0.57 | 0.07 | 0.11 |
| Ex. 19 | Two Alloy Method | 9.04 | 9.04 | 0.00 | 0.00 | 74.72 | 0.57 | 4.52 | 1.41 | 0.54 | 0.07 | 0.10 |
| Ex. 20 | Two Alloy Method | 9.94 | 9.94 | 0.00 | 0.00 | 73.07 | 0.56 | 4.42 | 1.38 | 0.52 | 0.07 | 0.10 |
| Ex. 21 | Two Alloy Method | 10.52 | 10.52 | 0.00 | 0.00 | 72.01 | 0.55 | 4.36 | 1.36 | 0.52 | 0.07 | 0.10 |
| Ex. 22 | Two Alloy Method | 9.90 | 9.90 | 0.00 | 0.00 | 72.81 | 0.56 | 4.77 | 1.37 | 0.52 | 0.07 | 0.10 |
| Ex. 23 | Two Alloy Method | 6.02 | 6.02 | 0.00 | 0.00 | 79.65 | 0.61 | 5.46 | 1.50 | 0.57 | 0.07 | 0.11 |
| Ex. 24 | Two Alloy Method | 6.71 | 6.71 | 0.00 | 0.00 | 78.39 | 0.60 | 5.37 | 1.48 | 0.56 | 0.07 | 0.10 |
| Ex. 25 | Two Alloy Method | 8.67 | 8.67 | 0.00 | 0.00 | 74.84 | 0.57 | 5.13 | 1.41 | 0.54 | 0.07 | 0.10 |
| Ex. 26 | Two Alloy Method | 9.88 | 9.88 | 0.00 | 0.00 | 72.65 | 0.55 | 4.98 | 1.37 | 0.52 | 0.07 | 0.10 |
| Ex. 27 | Two Alloy Method | 8.98 | 8.98 | 0.00 | 0.00 | 74.15 | 0.57 | 5.23 | 1.40 | 0.53 | 0.07 | 0.10 |
| Ex. 28 | Two Alloy Method | 6.69 | 6.69 | 0.00 | 0.00 | 78.14 | 0.60 | 5.67 | 1.47 | 0.56 | 0.07 | 0.10 |
| Ex. 29 | Two Alloy Method | 9.12 | 9.12 | 0.00 | 0.00 | 75.45 | 0.58 | 3.65 | 1.37 | 0.56 | 0.06 | 0.09 |
| Ex. 30 | Two Alloy Method | 9.18 | 9.18 | 0.00 | 0.00 | 75.91 | 0.58 | 3.98 | 0.46 | 0.56 | 0.06 | 0.09 |
| Ex. 31 | Two Alloy Method | 9.16 | 9.16 | 0.00 | 0.00 | 75.79 | 0.58 | 3.97 | 0.61 | 0.56 | 0.06 | 0.09 |
| Ex. 32 | Two Alloy Method | 9.14 | 9.14 | 0.00 | 0.00 | 75.56 | 0.58 | 3.96 | 0.91 | 0.56 | 0.06 | 0.09 |
| Ex. 33 | Two Alloy Method | 9.04 | 9.04 | 0.00 | 0.00 | 74.77 | 0.57 | 3.92 | 1.96 | 0.55 | 0.06 | 0.09 |
| Ex. 34 | Two Alloy Method | 9.01 | 9.01 | 0.00 | 0.00 | 74.54 | 0.57 | 3.91 | 2.25 | 0.55 | 0.06 | 0.09 |
| Ex. 35 | Two Alloy Method | 9.14 | 9.14 | 0.00 | 0.00 | 75.56 | 0.58 | 4.57 | 0.30 | 0.56 | 0.06 | 0.09 |
| Ex. 36 | Two Alloy Method | 9.12 | 9.12 | 0.00 | 0.00 | 75.45 | 0.58 | 4.56 | 0.46 | 0.56 | 0.06 | 0.09 |
| Ex. 37 | Two Alloy Method | 8.99 | 8.99 | 0.00 | 0.00 | 74.32 | 0.57 | 4.49 | 1.95 | 0.55 | 0.06 | 0.09 |
| Ex. 38 | Two Alloy Method | 8.96 | 8.96 | 0.00 | 0.00 | 74.10 | 0.57 | 4.48 | 2.24 | 0.55 | 0.06 | 0.09 |
| Ex. 39 | Two Alloy Method | 9.09 | 9.09 | 0.00 | 0.00 | 75.16 | 0.57 | 4.92 | 0.45 | 0.55 | 0.06 | 0.09 |
| Ex. 40 | Two Alloy Method | 8.95 | 8.95 | 0.00 | 0.00 | 74.04 | 0.56 | 4.85 | 1.94 | 0.55 | 0.06 | 0.09 |
| Ex. 41 | Two Alloy Method | 9.08 | 9.08 | 0.00 | 0.00 | 75.11 | 0.57 | 5.15 | 0.30 | 0.55 | 0.06 | 0.09 |
| Ex. 42 | Two Alloy Method | 8.93 | 8.93 | 0.00 | 0.00 | 73.88 | 0.56 | 5.06 | 1.94 | 0.54 | 0.06 | 0.09 |
| Ex. 43 | Two Alloy Method | 8.97 | 8.97 | 0.00 | 0.00 | 74.21 | 0.57 | 5.23 | 1.35 | 0.55 | 0.06 | 0.09 |
| Ex. 44 | Two Alloy Method | 9.03 | 9.03 | 0.00 | 0.00 | 74.71 | 0.57 | 5.50 | 0.45 | 0.55 | 0.06 | 0.09 |
| Ex. 45 | Single Alloy | 9.04 | 9.04 | 0.00 | 0.00 | 74.71 | 0.57 | 4.52 | 1.41 | 0.54 | 0.07 | 0.10 |
| Ex. 46 | Two Alloy Method | 10.56 | 7.34 | 0.00 | 0.00 | 75.51 | 0.00 | 4.51 | 1.40 | 0.55 | 0.05 | 0.09 |
| Ex. 47 | Two Alloy Method | 9.59 | 8.50 | 0.00 | 0.00 | 75.28 | 0.00 | 4.52 | 1.41 | 0.54 | 0.07 | 0.10 |
| Ex. 48 | Two Alloy Method | 7.43 | 10.69 | 0.00 | 0.00 | 75.22 | 0.00 | 4.56 | 1.38 | 0.58 | 0.08 | 0.07 |

| | x | y + z | a/b | c/b | d/b | (a − 2c)/(b − 14c) | d/(b − 14c) | |
|---|---|---|---|---|---|---|---|---|
| Ex. 1 | 0.3 | 0.00 | 0.23 | 0.061 | 0.018 | 0.77 | 0.124 | Comp. Ex. |
| Ex. 2 | 0.4 | 0.00 | 0.24 | 0.060 | 0.019 | 0.72 | 0.113 | Ex. |
| Ex. 3 | 0.5 | 0.00 | 0.24 | 0.060 | 0.019 | 0.76 | 0.118 | Ex. |
| Ex. 4 | 0.6 | 0.00 | 0.24 | 0.061 | 0.018 | 0.79 | 0.121 | Ex. |
| Ex. 5 | 0.7 | 0.00 | 0.24 | 0.061 | 0.018 | 0.80 | 0.119 | Ex. |

TABLE 2-continued

| | | | | | | | | |
|---|---|---|---|---|---|---|---|---|
| Ex. 6 | 0.8 | 0.00 | 0.24 | 0.061 | 0.019 | 0.78 | 0.123 | Comp. Ex. |
| Ex. 7 | 0.5 | 0.09 | 0.25 | 0.058 | 0.019 | 0.68 | 0.101 | Ex. |
| Ex. 8 | 0.5 | 0.18 | 0.24 | 0.059 | 0.019 | 0.69 | 0.115 | Ex. |
| Ex. 9 | 0.5 | 0.26 | 0.23 | 0.060 | 0.019 | 0.66 | 0.111 | Comp. Ex. |
| Ex. 10 | 0.5 | 0.00 | 0.24 | 0.048 | 0.019 | 0.44 | 0.057 | Comp. Ex. |
| Ex. 11 | 0.5 | 0.00 | 0.27 | 0.048 | 0.019 | 0.53 | 0.057 | Comp. Ex. |
| Ex. 12 | 0.5 | 0.00 | 0.17 | 0.052 | 0.019 | 0.24 | 0.069 | Comp. Ex. |
| Ex. 13 | 0.5 | 0.00 | 0.18 | 0.052 | 0.019 | 0.28 | 0.069 | Ex. |
| Ex. 14 | 0.5 | 0.00 | 0.24 | 0.052 | 0.019 | 0.50 | 0.069 | Ex. |
| Ex. 15 | 0.5 | 0.00 | 0.27 | 0.052 | 0.019 | 0.61 | 0.069 | Ex. |
| Ex. 16 | 0.5 | 0.00 | 0.29 | 0.052 | 0.019 | 0.68 | 0.069 | Comp. Ex. |
| Ex. 17 | 0.5 | 0.00 | 0.15 | 0.060 | 0.019 | 0.19 | 0.118 | Comp. Ex. |
| Ex. 18 | 0.5 | 0.00 | 0.17 | 0.060 | 0.019 | 0.28 | 0.118 | Ex. |
| Ex. 19 | 0.5 | 0.00 | 0.24 | 0.060 | 0.019 | 0.75 | 0.118 | Ex. |
| Ex. 20 | 0.5 | 0.00 | 0.27 | 0.060 | 0.019 | 0.94 | 0.118 | Ex. |
| Ex. 21 | 0.5 | 0.00 | 0.29 | 0.060 | 0.019 | 1.07 | 0.118 | Comp. Ex. |
| Ex. 22 | 0.5 | 0.00 | 0.27 | 0.065 | 0.019 | 1.56 | 0.208 | Ex. |
| Ex. 23 | 0.5 | 0.00 | 0.15 | 0.068 | 0.019 | 0.29 | 0.390 | Comp. Ex. |
| Ex. 24 | 0.5 | 0.00 | 0.17 | 0.068 | 0.019 | 0.71 | 0.390 | Ex. |
| Ex. 25 | 0.5 | 0.00 | 0.23 | 0.068 | 0.019 | 1.96 | 0.390 | Ex. |
| Ex. 26 | 0.5 | 0.00 | 0.27 | 0.068 | 0.019 | 2.79 | 0.390 | Comp. Ex. |
| Ex. 27 | 0.5 | 0.00 | 0.24 | 0.070 | 0.019 | 5.02 | 0.935 | Comp. Ex. |
| Ex. 28 | 0.5 | 0.00 | 0.17 | 0.072 | 0.019 | −3.25 | −2.338 | Comp. Ex. |
| Ex. 29 | 0.5 | 0.00 | 0.24 | 0.048 | 0.018 | 0.44 | 0.055 | Comp. Ex. |
| Ex. 30 | 0.5 | 0.00 | 0.24 | 0.052 | 0.006 | 0.50 | 0.022 | Comp. Ex. |
| Ex. 31 | 0.5 | 0.00 | 0.24 | 0.052 | 0.008 | 0.50 | 0.029 | Ex. |
| Ex. 32 | 0.5 | 0.00 | 0.24 | 0.052 | 0.012 | 0.50 | 0.044 | Ex. |
| Ex. 33 | 0.5 | 0.00 | 0.24 | 0.052 | 0.026 | 0.50 | 0.096 | Ex. |
| Ex. 34 | 0.5 | 0.00 | 0.24 | 0.052 | 0.030 | 0.50 | 0.110 | Comp. Ex. |
| Ex. 35 | 0.5 | 0.00 | 0.24 | 0.060 | 0.004 | 0.75 | 0.025 | Comp. Ex. |
| Ex. 36 | 0.5 | 0.00 | 0.24 | 0.060 | 0.006 | 0.75 | 0.038 | Ex. |
| Ex. 37 | 0.5 | 0.00 | 0.24 | 0.060 | 0.026 | 0.75 | 0.163 | Ex. |
| Ex. 38 | 0.5 | 0.00 | 0.24 | 0.060 | 0.030 | 0.75 | 0.188 | Comp. Ex. |
| Ex. 39 | 0.5 | 0.00 | 0.24 | 0.065 | 0.006 | 1.22 | 0.067 | Ex. |
| Ex. 40 | 0.5 | 0.00 | 0.24 | 0.065 | 0.026 | 1.22 | 0.289 | Ex. |
| Ex. 41 | 0.5 | 0.00 | 0.24 | 0.068 | 0.004 | 2.17 | 0.083 | Comp. Ex. |
| Ex. 42 | 0.5 | 0.00 | 0.24 | 0.068 | 0.026 | 2.17 | 0.542 | Comp. Ex. |
| Ex. 43 | 0.5 | 0.00 | 0.24 | 0.070 | 0.018 | 5.00 | 0.900 | Comp. Ex. |
| Ex. 44 | 0.5 | 0.00 | 0.24 | 0.073 | 0.006 | −4.27 | −0.273 | Comp. Ex. |
| Ex. 45 | 0.5 | 0.00 | 0.24 | 0.060 | 0.019 | 0.76 | 0.118 | Comp. Ex. |
| Ex. 46 | 0.4 | 0.00 | 0.24 | 0.060 | 0.019 | 0.72 | 0.113 | Ex. |
| Ex. 47 | 0.5 | 0.00 | 0.24 | 0.060 | 0.019 | 0.76 | 0.118 | Ex. |
| Ex. 48 | 0.6 | 0.00 | 0.24 | 0.061 | 0.018 | 0.79 | 0.121 | Ex. |

According to R-T-B based sintered magnet obtained in Exs. 1 to 6, the polished cross section parallel to the orientation axis was observed by SEM and EPMA, the grain boundary phase was identified, and the composition of main phase and of each grain boundary phase on the polished cut surface were evaluated. The observed image was read by in image analysis software. The evaluated results of the area ratio according to each grain boundary phase and the grain boundary phase coating ratio are shown in Table 3.

Magnetic characteristics of R-T-B based sintered magnet obtained in Exs. 1 to 6 were measured by BH tracer. As said magnetic characteristic, at the room temperature of 23° C., the above defined minimum magnetizing field Hmag, coercive force $HcJ_{_Hmag}$ of the minor hysteresis loop measured in the same minimum magnetizing field Hmag, the squareness ratio $Hk/HcJ_{_Hmag}$, and an indicator $H_{_50\%/Js}/HcJ_{_Hmag}$ of the minor curve flatness were evaluated. The lowering rate: β of the coercive force at a high temperature of 180° C. with respect to the coercive force at room temperature, the lowering rate: γ of the minor curve flatness at a high temperature of 180° C. with respect to the minor curve flatness at room temperature, were obtained. Results are shown in Table 3.

TABLE 3

| | Area Ratio of R-T-M phase (%) | Area Ratio of T-rich phase (%) | Area Ratio of R-rich phase (%) | Grain Boundary Phase Coating Rate (%) | Minimum Magnetizing Field Hmag (kOe) | Coercive Force $HcJ_{_Hmag}$ (kOe) | Squareness Ratio $Hk_{_Hmag}/HcJ_{_Hmag}$ | Minor Curve Flatness $H_{_50\%Js}/HcJ_{_Hmag}$ | Lowering Rate of Coercive Force δ (%/° C.) | Lowering Rate of Minor Curve Flatness ε (%/° C.) | |
|---|---|---|---|---|---|---|---|---|---|---|---|
| Ex. 1 | 69.6 | 0.0 | 30.4 | 82.3 | 10.0 | 7.3 | 0.90 | 0.51 | 0.46 | 0.32 | Comp. Ex. |
| Ex. 2 | 71.2 | 0.0 | 28.8 | 84.1 | 8.0 | 5.2 | 0.86 | 0.49 | 0.38 | 0.19 | Ex. |
| Ex. 3 | 69.0 | 0.0 | 31.0 | 85.6 | 7.0 | 4.7 | 0.87 | 0.49 | 0.34 | 0.16 | Ex. |
| Ex. 4 | 55.7 | 0.0 | 44.3 | 84.3 | 5.0 | 3.7 | 0.85 | 0.40 | 0.36 | 0.18 | Ex. |
| Ex. 5 | 18.5 | 41.2 | 40.3 | 70.1 | 4.0 | 1.8 | 0.80 | 0.26 | 0.42 | 0.21 | Ex. |
| Ex. 6 | 9.8 | 66.2 | 24.0 | 55.0 | 4.0 | 0.9 | 0.48 | 0.16 | 0.52 | 0.37 | Comp. Ex. |
| Ex. 7 | 63.6 | 16.8 | 19.6 | 85.5 | 7.0 | 4.5 | 0.83 | 0.43 | 0.35 | 0.14 | Ex. |
| Ex. 8 | 18.8 | 56.2 | 25.0 | 85.2 | 8.0 | 5.0 | 0.80 | 0.40 | 0.43 | 0.21 | Ex. |
| Ex. 9 | 8.9 | 67.3 | 23.8 | 76.8 | 8.0 | 5.8 | 0.69 | 0.37 | 0.53 | 0.33 | Comp. Ex. |

TABLE 3-continued

| | Area Ratio of R-T-M phase (%) | Area Ratio of T-rich phase (%) | Area Ratio of R-rich phase (%) | Grain Boundary Phase Coating Rate (%) | Minimum Magnetizing Field Hmag (kOe) | Coercive Force $HcJ_{Hmag}$ (kOe) | Squareness Ratio $Hk_{Hmag}/HcJ_{Hmag}$ | Minor Curve Flatness $H_{50\%Js}/HcJ_{Hmag}$ | Lowering Rate of Coercive Force δ (%/° C.) | Lowering Rate of Minor Curve Flatness ε (%/° C.) | |
|---|---|---|---|---|---|---|---|---|---|---|---|
| Ex. 10 | 8.3 | 70.3 | 21.4 | 67.7 | 4.0 | 0.9 | 0.68 | 0.22 | 0.48 | 0.33 | Comp. Ex. |
| Ex. 11 | 9.2 | 68.2 | 22.6 | 68.3 | 4.0 | 0.8 | 0.69 | 0.24 | 0.46 | 0.31 | Comp. Ex. |
| Ex. 12 | 9.7 | 60.3 | 30.0 | 70.2 | 4.0 | 1.3 | 0.80 | 0.26 | 0.46 | 0.31 | Comp. Ex. |
| Ex. 13 | 12.8 | 52.6 | 34.6 | 70.5 | 4.0 | 1.4 | 0.80 | 0.26 | 0.44 | 0.30 | Ex. |
| Ex. 14 | 60.7 | 15.3 | 24.0 | 71.0 | 7.0 | 3.5 | 0.82 | 0.40 | 0.35 | 0.14 | Ex. |
| Ex. 15 | 63.8 | 14.2 | 22.0 | 70.6 | 7.0 | 3.7 | 0.86 | 0.42 | 0.34 | 0.13 | Ex. |
| Ex. 16 | 9.2 | 7.8 | 83.0 | 70.1 | 8.0 | 3.8 | 0.83 | 0.25 | 0.46 | 0.31 | Comp. Ex. |
| Ex. 17 | 4.3 | 66.5 | 29.2 | 55.1 | 4.0 | 0.8 | 0.54 | 0.24 | 0.54 | 0.39 | Comp. Ex. |
| Ex. 18 | 11.8 | 30.2 | 58.0 | 70.2 | 4.0 | 1.4 | 0.81 | 0.29 | 0.44 | 0.28 | Ex. |
| Ex. 19 | 72.0 | 0.0 | 28.0 | 86.6 | 7.0 | 4.0 | 0.85 | 0.49 | 0.34 | 0.13 | Ex. |
| Ex. 20 | 65.8 | 10.2 | 24.0 | 80.3 | 7.0 | 4.3 | 0.87 | 0.49 | 0.34 | 0.13 | Ex. |
| Ex. 21 | 3.6 | 13.6 | 82.8 | 72.3 | 9.0 | 4.5 | 0.82 | 0.34 | 0.47 | 0.31 | Comp. Ex. |
| Ex. 22 | 16.8 | 32.0 | 51.2 | 73.2 | 7.0 | 4.1 | 0.86 | 0.49 | 0.42 | 0.23 | Ex. |
| Ex. 23 | 2.6 | 55.6 | 41.8 | 66.3 | 4.0 | 1.1 | 0.50 | 0.14 | 0.56 | 0.41 | Comp. Ex. |
| Ex. 24 | 44.4 | 20.3 | 35.3 | 72.3 | 5.0 | 1.7 | 0.81 | 0.26 | 0.40 | 0.20 | Ex. |
| Ex. 25 | 10.9 | 34.2 | 54.9 | 78.9 | 6.0 | 3.0 | 0.82 | 0.35 | 0.45 | 0.29 | Ex. |
| Ex. 26 | 9.7 | 10.6 | 79.7 | 70.0 | 6.0 | 3.3 | 0.83 | 0.36 | 0.46 | 0.31 | Comp. Ex. |
| Ex. 27 | 8.6 | 10.3 | 81.1 | 73.4 | 6.0 | 2.7 | 0.81 | 0.30 | 0.47 | 0.32 | Comp. Ex. |
| Ex. 28 | 7.9 | 20.3 | 71.8 | 68.2 | 3.0 | 1.1 | 0.80 | 0.25 | 0.48 | 0.33 | Comp. Ex. |
| Ex. 29 | 7.8 | 72.5 | 19.7 | 67.3 | 3.0 | 0.6 | 0.68 | 0.14 | 0.48 | 0.33 | Comp. Ex. |
| Ex. 30 | 8.5 | 68.2 | 23.3 | 70.3 | 4.0 | 2.1 | 0.81 | 0.26 | 0.47 | 0.32 | Comp. Ex. |
| Ex. 31 | 15.0 | 32.8 | 52.2 | 72.2 | 5.0 | 2.3 | 0.83 | 0.30 | 0.43 | 0.25 | Ex. |
| Ex. 32 | 36.7 | 23.9 | 39.4 | 78.5 | 6.0 | 2.8 | 0.82 | 0.39 | 0.38 | 0.18 | Ex. |
| Ex. 33 | 60.7 | 10.2 | 29.1 | 70.1 | 6.0 | 3.2 | 0.85 | 0.42 | 0.35 | 0.14 | Ex. |
| Ex. 34 | 2.4 | 16.3 | 81.3 | 57.1 | 3.0 | 1.1 | 0.72 | 0.21 | 0.49 | 0.36 | Comp. Ex. |
| Ex. 35 | 3.6 | 78.2 | 18.2 | 68.2 | 6.0 | 3.6 | 0.78 | 0.24 | 0.47 | 0.32 | Comp. Ex. |
| Ex. 36 | 18.0 | 31.0 | 51.0 | 73.4 | 6.0 | 4.0 | 0.82 | 0.36 | 0.41 | 0.22 | Ex. |
| Ex. 37 | 63.6 | 14.6 | 21.8 | 72.1 | 6.0 | 3.7 | 0.85 | 0.48 | 0.34 | 0.14 | Ex. |
| Ex. 38 | 2.7 | 14.2 | 83.1 | 60.2 | 5.0 | 2.6 | 0.74 | 0.24 | 0.48 | 0.34 | Comp. Ex. |
| Ex. 39 | 41.5 | 20.4 | 38.1 | 71.2 | 6.0 | 2.7 | 0.82 | 0.35 | 0.37 | 0.17 | Ex. |
| Ex. 40 | 38.6 | 25.6 | 35.8 | 71.1 | 6.0 | 2.5 | 0.84 | 0.42 | 0.38 | 0.17 | Ex. |
| Ex. 41 | 4.5 | 67.7 | 27.8 | 67.8 | 3.0 | 0.4 | 0.78 | 0.10 | 0.53 | 0.38 | Comp. Ex. |
| Ex. 42 | 8.8 | 12.5 | 78.7 | 70.3 | 6.0 | 2.0 | 0.82 | 0.26 | 0.47 | 0.32 | Comp. Ex. |
| Ex. 43 | 7.8 | 9.3 | 82.9 | 73.4 | 5.0 | 2.1 | 0.82 | 0.35 | 0.48 | 0.33 | Comp. Ex. |
| Ex. 44 | 6.8 | 10.2 | 83.0 | 70.5 | 3.0 | 1.2 | 0.78 | 0.28 | 0.50 | 0.35 | Comp. Ex. |
| Ex. 45 | 9.3 | 45.2 | 45.5 | 68.2 | 7.0 | 3.5 | 0.78 | 0.25 | 0.49 | 0.31 | Comp. Ex. |
| Ex. 46 | 70.2 | 0 | 29.8 | 83.8 | 8.0 | 5.1 | 0.86 | 0.50 | 0.40 | 0.19 | Ex. |
| Ex. 47 | 68.4 | 0 | 31.6 | 85.1 | 7.0 | 4.5 | 0.87 | 0.49 | 0.35 | 0.17 | Ex. |
| Ex. 48 | 55.1 | 0 | 44.9 | 84.2 | 5.0 | 3.6 | 0.85 | 0.40 | 0.37 | 0.19 | Ex. |

As shown in Table 3, the magnetic characteristic at room temperature according to R-T-B based sintered magnet of Exs. 2 to 5 satisfied the minimum magnetizing field of 8.0 kOe or less, the coercive force in minimum magnetizing field is 7.0 kOe or less, the squareness ratio at the minimum magnetizing field is 0.80 or more, and the minor curve flatness at the minimum magnetizing field is 0.25 or more. The lowering rate of the coercive force and the same of the minor curve flatness at high temperature were small. Thus, in a range of $0.4 \leq x \leq 0.7$, it was confirmed that a low coercive force, a high minor curve flatness, and small lowering rate of the coercive force and the same of the minor curve flatness at high temperature were shown. In addition, among all the examples, Exs. 2 to 4 satisfying $0.4 \leq x \leq 0.6$, were confirmed to show smaller lowering rate of the coercive force and the same of the minor curve flatness at high temperature.

Exs. 19, 7 to 9

Raw materials were combined to obtain R-T-B based sintered magnet having a composition shown in Table 2, and similar to Ex. 1, casting of a raw material alloy, coarse pulverization treatment, fine pulverization by jet mill, molding, sintering and aging treatment were performed to each composition.

Similar to Ex. 1, the compositional analysis was performed to R-T-B based sintered magnet of Exs. 19 and 7 to 9, and the result is shown in Table 2. Evaluation results of the area ratio of the grain boundary phase and the grain boundary phase coating rate and measurement results of the magnetic characteristics are each shown in Table 3. Magnetic characteristic in room temperature according to R-T-B based sintered magnet of Exs. 19, 7 and 8, satisfied the minimum magnetizing field of 8.0 kOe or less, the coercive force at the minimum magnetizing field of 7.0 kOe or less, the squareness ratio at the minimum magnetizing field of 0.80 or more, and the minor curve flatness at the minimum magnetizing field of 0.25 or more. The lowering rate of the coercive force and the same of the minor curve flatness at high temperature were small. Thus, in a range of $0.00 \leq y+z \leq 0.20$, it was confirmed that a low coercive force, a high minor curve flatness, and small lowering rate of the coercive force and the same of the minor curve flatness at high temperature were shown. In addition, among all the examples, Exs. 19 and 7 satisfying $0.00 \leq y+z \leq 0.10$, were confirmed to show smaller lowering rate of the coercive force and the same of the minor curve flatness at high temperature.

Exs. 10 to 18 and 20 to 28

Raw materials were combined to obtain R-T-B based sintered magnet having a composition shown in Table 2, and similar to Ex. 1, casting of a raw material alloy, coarse pulverization treatment, fine pulverization by jet mill, molding, sintering and aging treatment were performed to each composition.

Similar to Ex. 1, the compositional analysis was performed to R-T-B based sintered magnet of Exs. 10 to 18 and 20 to 28, and the result is shown in Table 2. Evaluation results of the area ratio of the grain boundary phase and the grain boundary phase coating rate and measurement results of the magnetic characteristics are each shown in Table 3.

Magnetic characteristic in room temperature according to R-T-B based sintered magnet of Exs. 13 to 15 and 18 to 20, satisfy the minimum magnetizing field of 8.0 kOe or less, the coercive force at the minimum magnetizing field of 7.0 kOe or less, the squareness ratio at the minimum magnetizing field of 0.80 or more, and the minor curve flatness at the minimum magnetizing field of 0.25 or more. The lowering rate of the coercive force and the same of the minor curve flatness at high temperature were small. Thus, in a range of $a/b \leq 0.28$ and $(a-2c)/(b-14c) \geq 0.30$, it was confirmed that a low coercive force, a high minor curve flatness, and small lowering rate of the coercive force and the same of the minor curve flatness at high temperature were shown. In addition, among all the examples, Exs. 14, 15, 19 and 20 satisfying $(a-2c)/(b-14c) \geq 0.25$ were confirmed to show smaller lowering rate of the coercive force and the same of the minor curve flatness at high temperature.

Magnetic characteristic in room temperature according to R-T-B based sintered magnet of Exs. 24 and 25, satisfy the minimum magnetizing field of 8.0 kOe or less, the coercive force at the minimum magnetizing field of 7.0 kOe or less, the squareness ratio at the minimum magnetizing field of 0.80 or more, and the minor curve flatness at the minimum magnetizing field of 0.25 or more. The lowering rate of the coercive force and the same of the minor curve flatness at high temperature were small. Thus, in a range of $a/b \leq 0.16$ and $(a-2c)/(b-14c) \leq 2.00$, it was confirmed that a low coercive force, a high minor curve flatness, and small lowering rate of the coercive force and the same of the minor curve flatness at high temperature were shown. In addition, among all the examples, Ex 24 satisfying $c/b \leq 0.070$ and $0.30 \leq (a-2c)/(b-14c) \leq 1.50$, was confirmed to show smaller lowering rate of the coercive force and the same of the minor curve flatness at high temperature.

Magnetic characteristic in room temperature according to R-T-B based sintered magnet of Exs. 14, 15, 19, 20 and 22, satisfy the minimum magnetizing field of 8.0 kOe or less, the coercive force at the minimum magnetizing field of 7.0 kOe or less, the squareness ratio at the minimum magnetizing field of 0.80 or more, and the minor curve flatness at the minimum magnetizing field of 0.25 or more. The lowering rate of the coercive force and the same of the minor curve flatness at high temperature were small. Thus, in a range of $c/b \geq 0.050$ and $(a-2c)/(b-14c) \leq 2.00$, it was confirmed that a low coercive force, a high minor curve flatness, and small lowering rate of the coercive force and the same of the minor curve flatness at high temperature were shown. In addition, among all the examples, Exs. 14, 15, 19 and 20, satisfying $(a-2c)/(b-14c) \leq 1.50$, were confirmed to show smaller lowering rate of the coercive force and the same of the minor curve flatness at high temperature.

Exs. 29 to 44

Raw materials were combined to obtain R-T-B based sintered magnet having a composition shown in Table 2, and similar to Ex. 1, casting of a raw material alloy, coarse pulverization treatment, fine pulverization by jet mill, molding, sintering and aging treatment were performed to each composition.

Similar to Ex. 1, the compositional analysis was performed to R-T-B based sintered magnet of Exs. 29 to 44, and the result is shown in Table 2. Evaluation results of the area ratio of the grain boundary phase and the grain boundary phase coating rate and measurement results of the magnetic characteristics are shown in Table 3.

Magnetic characteristic in room temperature according to R-T-B based sintered magnet of Exs. 14, 19, 33, 37 and 40, satisfied the minimum magnetizing field of 8.0 kOe or less, the coercive force at the minimum magnetizing field of 7.0 kOe or less, the squareness ratio at the minimum magnetizing field of 0.80 or more, and the minor curve flatness at the minimum magnetizing field of 0.25 or more. The lowering rate of the coercive force and the same of the minor curve flatness at high temperature were small. Thus, in a range of $c/b \geq 0.050$ and $d/(b-14c) \leq 0.500$, it was confirmed that a low coercive force, a high minor curve flatness, and small lowering rate of the coercive force and the same of the minor curve flatness at high temperature were shown.

Magnetic characteristic in room temperature according to R-T-B based sintered magnet of Exs. 36 and 39, satisfied the minimum magnetizing field of 8.0 kOe or less, the coercive force at the minimum magnetizing field of 7.0 kOe or less, the squareness ratio at the minimum magnetizing field of 0.80 or more, and the minor curve flatness at the minimum magnetizing field of 0.25 or more. The lowering rate of the coercive force and the same of the minor curve flatness at high temperature were small. Thus, in a range of $c/b \leq 0.070$ and $d/(b-14c) \geq 0.025$, it was confirmed that a low coercive force, a high minor curve flatness, and small lowering rate of the coercive force and the same of the minor curve flatness at high temperature were shown. In addition, among all the examples, Ex. 39, satisfying $d/(b-14c) \geq 0.040$, was confirmed to show smaller lowering rate of the coercive force and the same of the minor curve flatness at high temperature.

Magnetic characteristic in room temperature according to R-T-B based sintered magnet of Exs. 14, 19, 31 to 33, 36 and 37, satisfied the minimum magnetizing field of 8.0 kOe or less, the coercive force at the minimum magnetizing field of 7.0 kOe or less, the squareness ratio at the minimum magnetizing field of 0.80 or more, and the minor curve flatness at the minimum magnetizing field of 0.25 or more. The lowering rate of the coercive force and the same of the minor curve flatness at high temperature were small. Thus, in a range of $d/b \leq 0.028$ and $d/(b-14c) \geq 0.025$, it was confirmed that a low coercive force, a high minor curve flatness, and small lowering rate of the coercive force and the same of the minor curve flatness at high temperature were shown. In addition, among all the examples, Exs. 14, 19, 32, 33 and 37 satisfying $d/(b-14c) \geq 0.040$, were confirmed to show smaller lowering rate of the coercive force and the same of the minor curve flatness at high temperature.

Magnetic characteristic in room temperature according to R-T-B based sintered magnet of Exs. 19 and 39, satisfied the minimum magnetizing field of 8.0 kOe or less, the coercive force at the minimum magnetizing field of 7.0 kOe or less, the squareness ratio at the minimum magnetizing field of 0.80 or more, and the minor curve flatness at the minimum magnetizing field of 0.25 or more. The lowering rate of the coercive force and the same of the minor curve flatness at high temperature were small. Thus, in a range of $d/b \geq 0.005$, it was confirmed that a low coercive force, a high minor curve flatness, and small lowering rate of the coercive force and the same of the minor curve flatness at high temperature were shown.

Among R-T-B based sintered magnet of Exs. 1 to 44, the R-T-B based sintered magnet of Exs. 1 to 5, 7, 8, 12 to 16, 18 to 22, 24 to 27, 30 to 33, 36, 37, 19, 40 and 42 to 44 satisfying the minimum magnetizing field of 8.0 kOe or less, the coercive force at the minimum magnetizing field of 7.0 kOe or less, the squareness ratio at the minimum magnetizing field of 0.80 or more, and the minor curve flatness at the minimum magnetizing field of 0.25 or more, satisfied the grain boundary phase coating rate of 70.0% or more.

Among R-T-B based sintered magnet of Exs. 1 to 44, the R-T-B based sintered magnet of Exs. 2 to 5, 7, 8, 13 to 15, 18 to 20, 22, 24, 25, 31 to 33, 36, 37, 39 and 40 satisfied, at room temperature, the minimum magnetizing field of 8.0 kOe or less, the coercive force at the minimum magnetizing field of 7.0 kOe or less, the squareness ratio at the minimum magnetizing field of 0.80 or more, the minor curve flatness at the minimum magnetizing field of 0.25 or more, and showed small lowering rate of the coercive force and the same of the minor curve flatness at high temperature. And said R-T-B based sintered magnets showed that, with respect to the total grain boundary phase area, the area ratio of R-T-M phase was 10.0% or more, the area ratio of T-rich phase was 60.0% or less, and the area ratio of R-rich phase was 70.0% or less. In particular, according to the R-T-B based sintered magnet of Exs. 1 to 4, 7, 14, 15, 19, 20, 24, 32, 33, 37, 39 and 40 showing further small lowering rate of the coercive force and the same of the minor curve flatness at high temperature, with respect to the total grain boundary phase area, the area ratio of R-T-M phase was 20.0% or more, the area ratio of T-rich phase was 30.0% or less, and the area ratio of R-rich phase was 50.0% or less.

Exs. 19 and 45

The raw material were combined to obtain the R-T-B based sintered magnet having a composition of Ex. 45 shown in Table 2 by one kind of an alloy, and was dissolved and casted by the strip cast method. Then a flake formed raw material alloy was obtained.

The obtained raw material alloy, similar to Ex. 1, was coarse pulverized, fine pulverized by jet mill, molded, sintered and aging treated.

Similar to Ex. 1, the compositional analysis was performed to R-T-B based sintered magnet of Ex. 45, and the result is shown in Table 2. Evaluation results of the area ratio of the grain boundary phase and the grain boundary phase coating rate and measurement results of the magnetic characteristics are each shown in Table 3. According to the R-T-B based sintered magnet of Ex. 45, the squareness ratio at the minimum magnetizing field is less than 0.80, the minor curve flatness at the minimum magnetizing field is less than 0.25, and the area ratio of the R-T-M phase with respect to a total grain boundary phase area is less than 10.0%.

Exs. 2 to 4 and 46 to 48

The raw material were combined to obtain the R-T-B based sintered magnet having a composition shown in Table 2. Similar to Exs. 2 to 4, casting of a raw material alloy, coarse pulverization treatment, fine pulverization by jet mill, molding, sintering and aging treatment were performed to each composition.

Similar to Ex. 1, the compositional analysis was performed to R-T-B based sintered magnet of Exs. 46 to 48, and the result is shown in Table 2. Evaluation results of the area ratio of the grain boundary phase and the grain boundary phase coating rate and measurement results of the magnetic characteristics are each shown in Table 3.

R-T-B based sintered magnet according to Exs. 46 to 48 satisfied, in the room temperature, the minimum magnetizing field of 8.0 kOe or less, the coercive force at the minimum magnetizing field of 7.0 kOe or less, the squareness ratio at the minimum magnetizing field of 0.80 or more, and the minor curve flatness in the minimum magnetizing field of 0.25 or more. In addition, the lowering rate of the coercive force and the same of the minor cure flatness were small. Thus, it was confirmed that the same effect obtained from the samples, Exs. 2 to 4 in which Fe is partly substituted, can be obtained even when Fe is not partly substituted by Co.

Hereinbefore, the invention is described based on the embodiments. The embodiments are examples and can be varied within the scope of the claims of the invention. It is also realized by person in the art that such variations are within the scope of the claims of the invention. Therefore, description of the specification is not limited thereto and is treated as an exemplification.

INDUSTRIAL APPLICABILITY

According to the present invention, R-T-B based sintered magnet, preferable for the variable magnetic force motor capable to maintain a high efficiency in a wide rotational speed range and usable in a high temperature, can be provided.

NUMERICAL REFERENCES

1 . . . main phase crystal grains
1' . . . main phase crystal grains
2 . . . grain boundary phase
3 . . . a part where an outline of the cross section of the main phase crystal grains contacts the grain boundary
4 . . . a part where an outline of the cross section of the main phase crystal grains contacts the main phase crystal grains

The invention claimed is:

1. An R-T-B based rare earth permanent magnet expressed by a compositional formula: $(R1_{1-x}(Y_{1-y-z}\ Ce_y\ La_z)_x)_a T_b B_c M_d$ wherein, R is a rare earth element, R1 is one or more rare earth elements not including Y, Ce and La, T is Fe, or Fe and Co, and optionally contains one or more other transition metals, M is Ga or Ga and one or more selected from the group consisting of Sn, Bi and Si, $0.4 \le x \le 0.7$, $0.00 \le y+z \le 0.20$, $0.16 \le a/b \le 0.28$, $0.050 \le c/b \le 0.070$, $0.005 \le d/b \le 0.028$, $0.25 \le (a-2c)/(b-14c) \le 2.00$ and $0.025 \le d/(b-14c) \le 0.500$, x, y, z, a, b, c and d are atomic ratios, the R-T-B based rare earth permanent magnet has a structure comprising a main phase, comprising a compound having a $R_2T_{14}B$ tetragonal structure, and a grain boundary phase, on an arbitrary cross sectional area, an area ratio of an R-T-M phase, having a $La_6Co_{11}Ga_3$ crystal structure, to a total grain boundary phase area is 10.0% or more, an area ratio of T-rich phase to the total grain boundary phase area is 60.0% or less, in which said T-rich phase shows [R]/[T]<1.0, when [R] and [T] are number of atoms of R and T respectively, and differs from the above R-T-M phase, an area ratio of R-rich phase to the total grain boundary phase area is 70.0% or less, in which said R-rich phase shows [R]/[T]>1.0, when [R] and [T] are number of atoms of R and T respectively, and a coating rate of the grain boundary phase is 70.0% or more, wherein a coercive force ($HcJ_{_Hmag}$) is 7.0 kOe or less.

2. The R-T-B based rare earth permanent magnet according to claim 1, wherein $0.4 \leq x \leq 0.6$, $0.00 \leq y+z \leq 0.10$, $0.30 \leq (a-2c)/(b-14c) \leq 1.50$ and $0.04 \leq d/(b-14c) \leq 0.50$, and on an arbitrary cross sectional area, the area ratio of the R-T-M phase to the total grain boundary phase area is 20.0% or more, the area ratio of the T-rich phase to the total grain boundary phase area is 30.0% or less, and the area ratio of the R-rich phase to the total grain boundary phase area is 50.0% or less.

3. The R-T-B based rare earth permanent magnet according to claim 1, wherein the coercive force ($HcJ_{_Hmag}$) is 5.3 kOe or less.

4. The R-T-B based rare earth permanent magnet according to claim 1, which is a variable magnetic flux magnet.

* * * * *